US007950649B2

(12) United States Patent
Katsura et al.

(10) Patent No.: US 7,950,649 B2
(45) Date of Patent: May 31, 2011

(54) PAPER FEEDER, IMAGE FORMING APPARATUS PROVIDED WITH THE SAME AND PAPER FEEDING METHOD

(75) Inventors: Norichika Katsura, Tenri (JP); Tadasu Taniguchi, Uda (JP); Masahiko Fujita, Nara (JP); Masaharu Kimura, Daito (JP)

(73) Assignee: Sharp Kabushiki Kaisha, Osaka (JP)

( * ) Notice: Subject to any disclaimer, the term of this patent is extended or adjusted under 35 U.S.C. 154(b) by 231 days.

(21) Appl. No.: 12/244,077

(22) Filed: Oct. 2, 2008

(65) Prior Publication Data

US 2009/0096153 A1 Apr. 16, 2009

(30) Foreign Application Priority Data

Oct. 12, 2007 (JP) ..... 2007-266321

(51) Int. Cl.
*B65H 5/00* (2006.01)

(52) U.S. Cl. ..... 271/10.03; 271/10.11; 271/125

(58) Field of Classification Search ..... 271/10.03, 271/10.11, 10.09, 122, 125
See application file for complete search history.

(56) References Cited

U.S. PATENT DOCUMENTS

| | | | | |
|---|---|---|---|---|
| 5,395,106 | A | 3/1995 | Tohnai et al. | |
| 5,924,686 | A * | 7/1999 | Jacobson et al. | 271/3.17 |
| 6,588,740 | B2 * | 7/2003 | Brugger et al. | 271/10.03 |

FOREIGN PATENT DOCUMENTS

| | | |
|---|---|---|
| JP | 06-092490 | 4/1994 |
| JP | 1994-0156815 | 6/1994 |
| JP | 2003-072988 | 3/2003 |

* cited by examiner

*Primary Examiner* — Michael C McCullough
(74) *Attorney, Agent, or Firm* — Renner, Otto, Boisselle & Sklar, LLP

(57) ABSTRACT

When two or more sheets of paper P are fed in an overlapped manner to a nip where a paper feed roller and a separation roller are in pressure contact with each other, a sub-CPU of a sheet feeding unit rotates the paper feed roller in a paper feeding direction and rotates the separation roller in a direction opposite to the feeding direction, so as to separate overlapping, and thereafter, it rotates the paper feed roller and the separation roller again in the feeding direction.

10 Claims, 14 Drawing Sheets

PAPER FEEDER, IMAGE FORMING APPARATUS PROVIDED WITH THE SAME AND PAPER FEEDING METHOD

CROSS-REFERENCE TO RELATED APPLICATION

This nonprovisional application claims priority under 35 U.S.C. §119(a) on Patent Application No. 2007-266321 filed in Japan on Oct. 12, 2007, the entire contents of which are hereby incorporated by reference.

BACKGROUND OF THE INVENTION

1. Field of the Invention

The present invention relates to a technique for feeding sheets of paper, contained stacked in a paper feed cassette, one by one from the top layer to a paper feed path and, more specifically, to a technique improving possibility of recovery to a normal paper feeding state.

2. Description of the Background Art

As is well known, an image forming apparatus such as a copy machine is provided with a paper feeder for feeding sheets of paper contained stacked in a paper feed cassette one by one from the top layer to the paper feed path.

The paper feeder includes a paper feed unit for feeding the sheets one by one from the paper feed cassette to the paper feed path, and a paper feed sensor for detecting whether or not the sheet has actually been fed out from the paper feed unit. Typically, the paper feed unit is provided with a pick-up roller that is brought into contact with the uppermost one of the sheets stored in the paper feed cassette, and retard rollers implemented by a paper feed roller and a separation roller positioned one above the other to form a pair.

In the paper feeder, when a start key of the image forming apparatus is operated, the pick-up roller, and the paper feed roller and separation roller start to rotate in a direction of feeding the sheet of paper. One sheet, which is separated and taken out as it passes through the retard rollers, passes through the paper feed sensor, and thereafter it is transmitted by a sheet feeding unit to an image forming unit.

If the paper feed sensor does not detect presence of any sheet even after a prescribed time period from the start of sheet feeding, it is determined that paper feed failed because of a paper jam at the paper feed unit, an indication is given accordingly on a display panel of an operation unit, and the operation of the apparatus is stopped. For recovery from this state, an operator opens a cover provided on a front side of the copy machine, removes the jammed paper, aligns the sheets in the paper cassette, and presses a reset switch again.

In the paper feeder having such a structure, whenever the paper feed sensor fails to detect any sheet within a prescribed time period, it is determined that paper jam occurred and the machine operation is stopped, and the recovery work described above is required each time.

Paper feed failure, however, may occur not because of the jam but because of life of the paper feed roller. If the paper feed fails because of the life of paper feed roller, it is often the case that normal paper feed may be resumed after repeating a few paper feed operations.

A paper feeder as a solution to the problem is disclosed in U.S. Pat. No. 5,395,106. In the paper feeder, if a sheet fed from the paper feed cassette is not detected by the paper feed sensor, the paper feeding operation of the paper feed unit is repeated for a prescribed number of times. According to this technique, unnecessary suspension of the feeder operation can be avoided at the time of paper feed failure.

The paper feeder, however, has the following disadvantages.

Referring to FIG. 1, assume that a pick-up roller 2000, and a paper feed roller 2002 and a separation roller 2004 forming a vertical pair are rotated in a paper feeding direction to realize the paper feeding operation. Here, it is possible that a sheet 2006 on a lower side is fed to rollers 2002 and 2004 serving as retard rollers, overlapped with an upper sheet 2008 with the tip end of lower sheet 2006 protruded to the downstream side of the paper feeding direction than the tip end of upper sheet 2008 (that is, lower sheet 2006 goes ahead of upper sheet 2008). This situation is shown in FIG. 1A.

In this state, when rotation of roller 2004 is reversed to the sheet returning direction to separate the sheets, the lower sheet 2006 is fed by roller 2002 to the downstream side of paper feeding direction and its tip end comes to protrude from a nip formed by rollers 2002 and 2004. Consequently, paper feed sensor 2010 is once turned ON. Thereafter, the lower sheet 2006 that has turned ON the sensor 2010 is returned to the upstream side of paper feeding direction by roller 2004, and thus, sensor 2010 is turned OFF. At this time, the two sheets fed overlapped with each other come to be kept as they are at the nip formed by rollers 2002 and 2004, with the tip end of upper sheet 2008 slightly protruding to the downstream side of paper feeding direction than the tip end of lower sheet 2006. As a result, feed sensor 2016 arranged downstream side of the conveyor rollers 2012 and 2014 in the paper feeding direction is kept OFF. Specifically, the state of FIG. 1B changes to that of FIG. 1C.

As described above, dependent on the state of overlapped feeding of sheets, it is possible that presence of a sheet fed from the paper feed cassette by the paper feed operation is once detected by a sensor 2010 provided on the paper feed path and after a sheet separating operation, the presence of the sheet may not be detected by the sensor 2010 any longer. Though the normal state may be recovered by another paper feed operation, such a situation is determined to be a paper jam before reaching feed sensor 2016, an indication to that effect is given on the display panel of the operating unit, and the operation of the apparatus is stopped.

SUMMARY OF THE INVENTION

Therefore, an object of the present invention is to provide a paper feeder that can improve possibility of recovering normal paper feed state, an image forming apparatus provided with the feeder, and a paper feeding method.

Another object of the present invention is to provide a paper feeder that can prevent unnecessary suspension of the operation at the time of a paper feed failure, an image forming apparatus provided with the feeder, and a paper feeding method.

According to an aspect, the present invention provides a paper feeder feeding sheets of paper contained stacked in a paper feed cassette one by one from an uppermost layer to a paper feed path, including: a paper feed roller and a separation roller forming a pair in a vertical direction and by rotating in a paper feeding direction, passing the sheet of paper through a first nip where the rollers are in pressure contact with each other; a first paper sensor arranged on a downstream side of the paper feed roller in the feeding direction; a pair of conveyor rollers forming a pair in the vertical direction, arranged on the downstream side of the paper feed roller and the separation roller in the paper feeding direction, and by rotating in the feeding direction, passing the sheet of paper through a second nip where the rollers are in pressure contact with each other; and a second paper sensor arranged on a downstream side of the conveyor roller pair in the feeding direction. A first controller causes the paper feed roller to rotate in the feeding direction and causes the separation roller to rotate in a direction opposite to the feeding direction, when the first paper sensor detects the paper and a plurality of sheets of paper exist at the first nip, and a second controller causes the paper feed roller and the separation roller to rotate in the feeding direction, when the paper is once detected but thereafter no longer detected by the first paper sensor, and the paper is not detected by the second paper sensor within a prescribed time period.

As described above, when two or more sheets of paper are fed overlapped with each other to the first nip, overlapped feeding is resolved by the operation of the first controller, and thereafter the second controller again rotates the paper feed roller and the separation roller in the direction of feeding the paper, whereby the possibility of recovering the normal paper feed state can be improved.

Preferably, the paper feeder further includes a third controller causing the paper feed roller and the separation roller to rotate in the feeding direction, when the paper is not detected by the first paper sensor. As a result, the possibility of recovering the normal paper feed state can further be improved.

More preferably, the paper feeder further includes a fourth controller causing the paper feed roller and the separation roller to repeat rotation in the feeding direction for a prescribed number of times, by controlling the second controller. As a result, the possibility of recovering the normal paper feed state can further be improved.

The prescribed number mentioned above should preferably be set to three to five. Larger number possibly results in shorter life of the paper feed roller and the separation roller.

More preferably, the paper feeder further includes a fifth controller stopping an operation of the paper feeder, after the second controller caused the paper feed roller and the separation roller to repeat rotation in the feeding direction for a prescribed number of times. As a result, at the time of paper feed failure, unnecessary suspension of the feeder operation can be avoided.

More preferably, the paper feeder further includes a display unit for displaying information to be notified to a user, and a sixth controller causing the display unit to display an indication of paper failure, in response to the fifth controller stopping operation of the paper feeder. As a result, at the time of paper feed failure, unnecessary suspension of the feeder operation can be avoided, and the user readily recognizes the paper feed failure. Thus, convenience for the user can further be improved.

More preferably, the second controller sets rotation speed of the paper feed roller slower than rotation speed before detection of the paper by the first paper sensor.

As a result, when the second controller operates, frictional force between the sheet and each of the paper feed roller and the separation roller can be increased than before the detection of the sheet by the first paper sensor. Therefore, each of the paper feed roller and the separation roller is less prone to slippage on the sheet. As a result, the sheet can more reliably be fed toward the first paper sensor. The effect is particularly significant when the separation roller is driven following the rotation of the paper feed roller.

According to another aspect, the present invention provides an image forming apparatus, including: a paper feeder feeding sheets of paper contained stacked in a paper feed cassette one by one from an uppermost layer to a paper feed path, including a paper feed roller and a separation roller forming a pair in a vertical direction and by rotating in a paper feeding direction, passing the sheet of paper through a first nip where the rollers are in pressure contact with each other, a first paper sensor arranged on a downstream side of the paper feed roller in the feeding direction, a pair of conveyor rollers forming a pair in the vertical direction, arranged on the downstream side of the paper feed roller and the separation roller in the paper feeding direction, and by rotating in the feeding direction, passing the sheet of paper through a second nip where the rollers are in pressure contact with each other, a second paper sensor arranged on a downstream side of the conveyor roller pair in the feeding direction, a first controller causing the paper feed roller to rotate in the feeding direction and causing the separation roller to rotate in a direction opposite to the feeding direction, when the first paper sensor detects the paper and a plurality of sheets of paper exist at the first nip, and a second controller causing the paper feed roller and the separation roller to rotate in the feeding direction, when the paper is once detected but thereafter no longer detected by the first paper sensor, and the paper is not detected by the second paper sensor within a prescribed time period; and an image forming unit forming a desired image on a sheet of paper fed to the paper feed path.

As described above, the image forming apparatus includes a paper feeder in which, when two or more sheets of paper are fed overlapped with each other to the first nip, overlapped feeding is resolved by the operation of the first controller, and thereafter the second controller again rotates the paper feed roller and the separation roller in the feeding direction. Therefore, the possibility of recovering the normal paper feed state can be improved, and smoother image forming becomes possible.

According to a still further aspect, the present invention provides a paper feeding method of feeding sheets of paper contained stacked in a paper feed cassette one by one from an uppermost layer to a paper feed path, including the steps of: rotating, in a paper feeding direction, a paper feed roller and a separation roller forming a pair in a vertical direction to form a first nip, and thereby passing the sheet of paper through the first nip; rotating, in the paper feeding direction, a pair of conveyor rollers arranged downstream of the paper feed roller and the separation roller in the feeding direction and forming a pair in the vertical direction to form a second nip, and thereby passing the sheet of paper through the second nip; rotating the paper feed roller in the feeding direction and rotating the separation roller in a direction opposite to the feeding direction, when a first paper sensor, provided on the downstream side of the paper feed roller in the feeding direction, detects the paper and a plurality of sheets of paper exist at the first nip; and rotating the paper feed roller and the separation roller in the feeding direction, when the paper is once detected but thereafter no longer detected by the first paper sensor, and the paper is not detected by a second paper sensor, arranged on the downstream side of the conveyor roller pair in the feeding direction, within a prescribed time period.

As described above, when two or more sheets of paper are fed overlapped with each other to the first nip, the paper feed roller is rotated in the paper feeding direction and the separation roller is rotated in the direction opposite to the feeding direction to resolve the overlapped feeding of the sheets, and thereafter, the paper feed roller and the separation roller are again rotated in the paper feeding direction. Therefore, the possibility of recovering the normal paper feed state can be improved.

According to a still further aspect, the present invention provides a paper feed program, causing, when executed by a computer, the computer to execute a paper feeding method of feeding sheets of paper contained stacked in a paper feed cassette one by one from an uppermost layer to a paper feed path, including the steps of: rotating, in a paper feeding direction, a paper feed roller and a separation roller forming a pair in a vertical direction to form a first nip, and thereby passing the sheet of paper through the first nip; rotating, in the paper feeding direction, a pair of conveyor rollers arranged downstream of the paper feed roller and the separation roller in the feeding direction and forming a pair in the vertical direction to form a second nip, and thereby passing the sheet of paper through the second nip; rotating the paper feed roller in the feeding direction and rotating the separation roller in a direction opposite to the feeding direction, when a first paper sensor, provided on the downstream side of the paper feed roller in the feeding direction, detects the paper and a plurality of sheets of paper exist at the first nip; and rotating the paper feed roller and the separation roller in the feeding direction, when the paper is once detected but thereafter no longer detected by the first paper sensor, and the paper is not detected by a second paper sensor, arranged on the downstream side of the conveyor roller pair in the feeding direction, within a prescribed time period.

By the execution of such a program, when two or more sheets of paper are fed overlapped with each other to the first nip, the paper feed roller is rotated in the paper feeding direction and the separation roller is rotated in the direction opposite to the feeding direction to resolve the overlapped feeding of the sheets, and thereafter, the paper feed roller and the separation roller are again rotated in the paper feeding direction, whereby the possibility of recovering the normal paper feed state can be improved.

According to a still further aspect, the present invention provides a computer-readable recording medium recording a paper feed program, causing, when executed by a computer, the computer to execute a paper feeding method of feeding sheets of paper contained stacked in a paper feed cassette one by one from an uppermost layer to a paper feed path, including the steps of: rotating, in a paper feeding direction, a paper feed roller and a separation roller forming a pair in a vertical direction to form a first nip, and thereby passing the sheet of paper through the first nip; rotating, in the paper feeding direction, a pair of conveyor rollers arranged downstream of the paper feed roller and the separation roller in the feeding direction and forming a pair in the vertical direction to form a second nip, and thereby passing the sheet of paper through the second nip; rotating the paper feed roller in the feeding direction and rotating the separation roller in a direction opposite to the feeding direction, when a first paper sensor, provided on the downstream side of the paper feed roller in the feeding direction, detects the paper and a plurality of sheets of paper exist at the first nip; and rotating the paper feed roller and the separation roller in the feeding direction, when the paper is once detected but thereafter no longer detected by the first paper sensor, and the paper is not detected by a second paper sensor, arranged on the downstream side of the conveyor roller pair in the feeding direction, within a prescribed time period.

As to the recording medium, a memory itself allowing processing by a CPU (Central Processing Unit), such as an RAM (Random Access Memory) or an ROM (Read Only Memory) may be the recording medium. Alternatively, a program reading device may be provided as an external storage to the computer, and the recording medium may be one that is readable when loaded to the device. In any case, the recorded paper feed program is executed by the CPU accessing to the recording medium. Alternatively, the CPU may read the paper feed program from the recording medium, and the read paper feed program may be downloaded to a program storage area for execution. In that case, the program to be downloaded is stored in a prescribed storage in advance. CPU generally controls various units of the computer so that prescribed paper feed process is performed in accordance with the installed paper feed program.

Examples of the recording medium that can be read by the program reading device may be media that can fixedly record a program, including (1) tapes such as a magnetic tape and a cassette tape, (2) disks such as a magnetic disc including flexible disk (FD) and hard disk, or optical disk including a CD-ROM (Compact Disc-Read Only Memory), MO (Magento-Optical Disk), MD (Mini Disk) and DVD (Digital Versatile Disk) (3) cards such as an optical card and an IC (Integrated Circuit) card including a memory card, and (4) semiconductor memories such as a mask ROM, EPROM (Erasable Programmable Read Only Memory), EEPROM (Electrically Erasable Programmable Read Only Memory) and a flash memory.

Further, the computer may be configured to allow connection to a communication network including the Internet, and the medium may carry the program in a non-fixed manner, with the paper feed program downloaded from the communication network. When the paper feed program is to be downloaded from the communication network, the downloading program may be stored in advance in the computer, or it may be installed from a different recording medium.

An example of the computer system that executes the paper feed program read from the recording medium described above may by a system formed by (1) an image reading device such as a flat bed scanner, a film scanner or a digital camera, (2) a computer performing various processes including the paper feed method described above by executing various programs, (3) an image display device such as a CRT (Cathode Ray Tube) display or a liquid crystal display for displaying the result of processing by the computer and the like, and (4) an image output device such as a printer that outputs the result of processing by the computer on a sheet of paper. Further, the computer system may preferably include a modem or the like enabling connection to a server through the communication network, for transmitting/receiving various pieces of information such as image information and various programs including the paper feed program.

According to the present invention, when two or more sheets of paper are fed overlapped with each other to the first nip, where the paper feed roller and the separation roller are in pressure-contact with each other, the first controller rotates the paper feed roller in the paper feeding direction and rotates the separation roller in the direction opposite to the feeding direction to eliminate the overlapped feeding and, thereafter, the second controller again rotates the paper feed roller and the separation roller in the paper feeding direction. Therefore, the possibility of recovering the normal paper feed state can be improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

<Overall Structure>

Figure 1A:
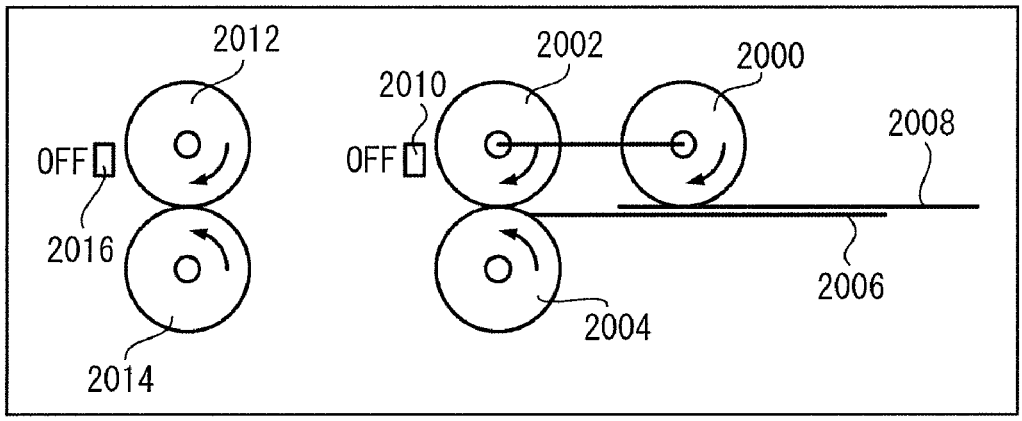
FIG. 1A PRIOR ART
FIGS. 1A to 1C illustrate a problem experienced in the prior art.
Figure 1B:
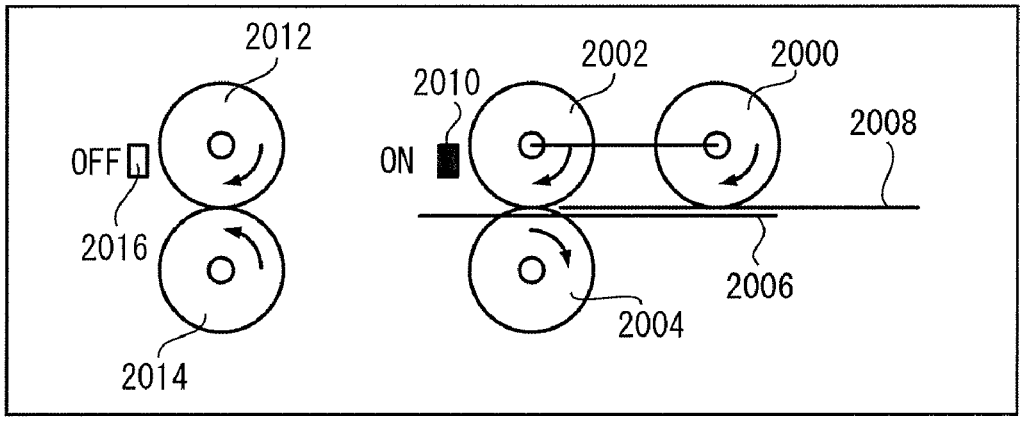
FIG. 1B PRIOR ART
Figure 1C:
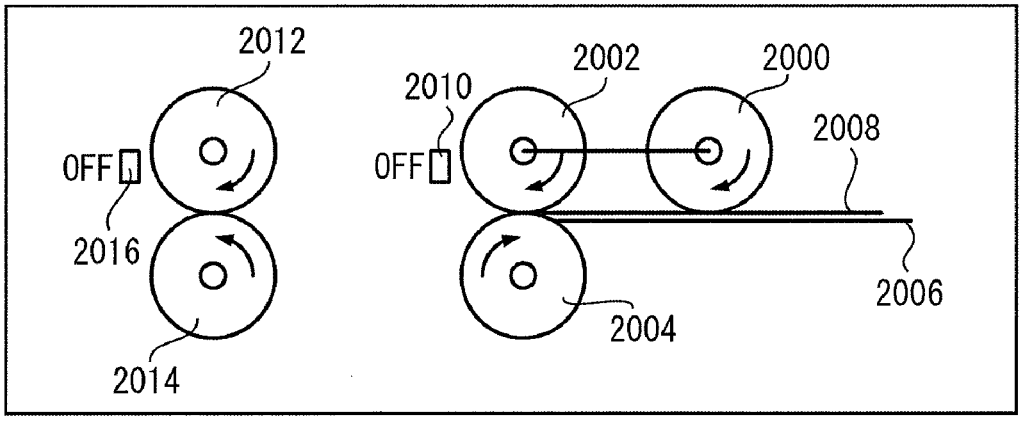
FIG. 1C PRIOR ART
Figure 2:
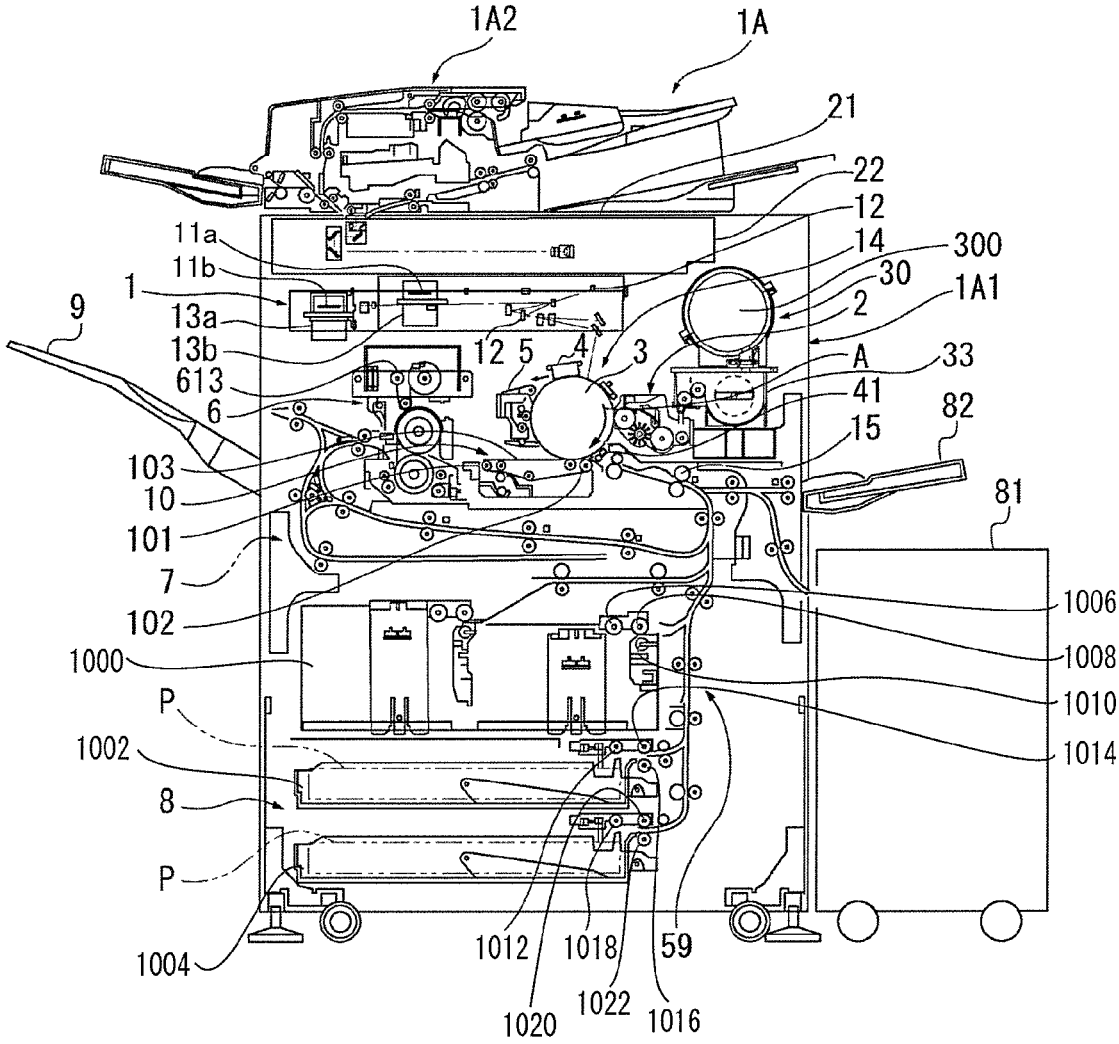
FIG. 2 shows an overall structure of the image forming apparatus in accordance with an embodiment of the present invention.
Figure 3:
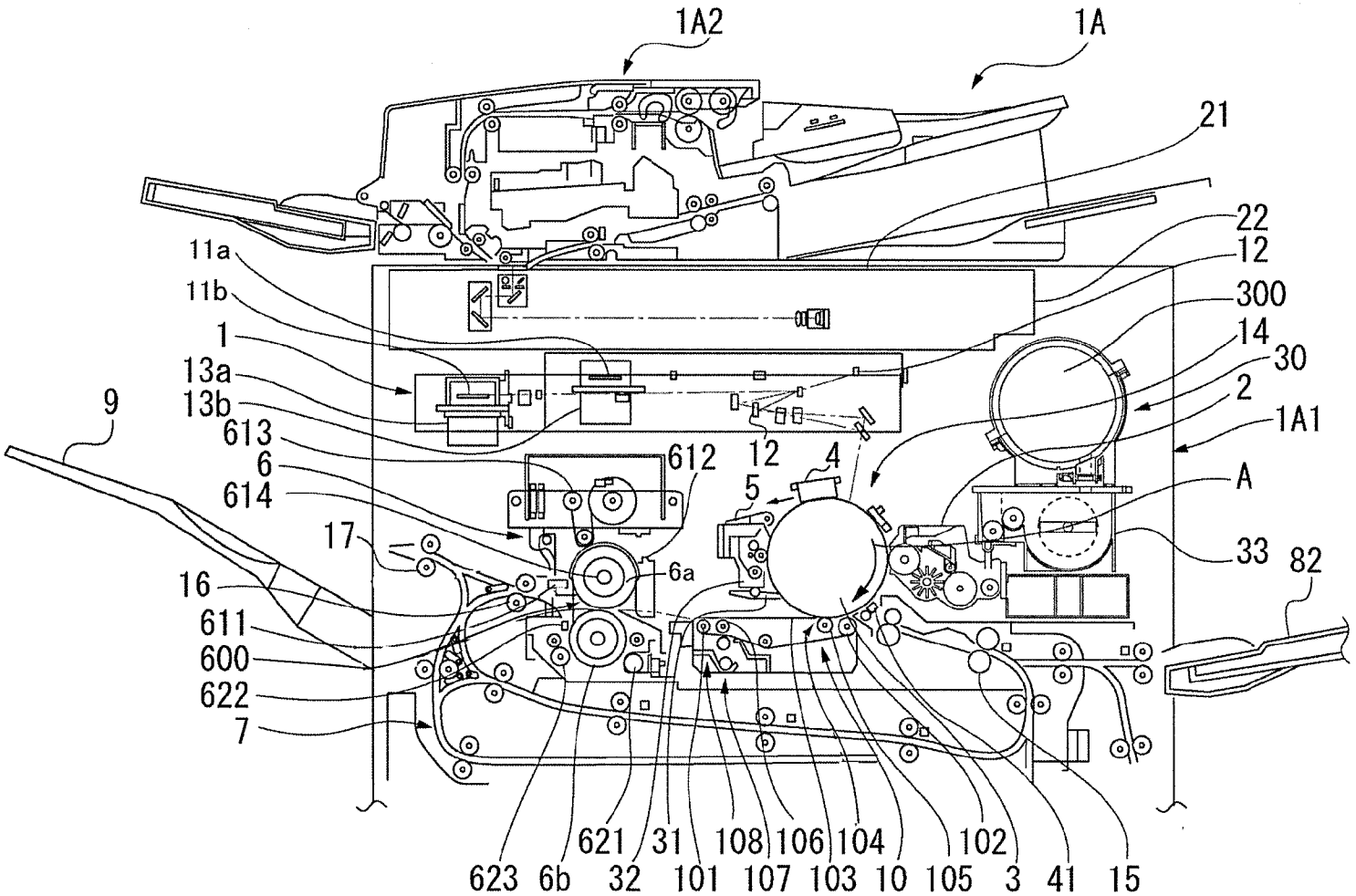
FIG. 3 shows, in enlargement, a structure of an upper portion of the image forming apparatus shown in FIG. 2.

Referring to FIGS. 2 and 3, an image forming apparatus 1A in accordance with the present embodiment is, by way of example, a multifunctional printer (MFP) including copy, printer and facsimile functions. Image forming apparatus 1A outputs image data read by a scanner or the like or image data transmitted from an external device such as a client personal computer (hereinafter referred to as a "client PC") 1120 shown in FIG. 5 or the like, on a sheet of paper P by electrophotographic technique, as a monochrome (single color) image. Specifically, in image forming apparatus 1A, an electrostatic latent image corresponding to image data is formed on a surface of a photoreceptor drum 3, which is driven to rotate, the formed electrostatic latent image is visualized as a toner image by a two-component developer charged by mixing electric toner with magnetic carrier, and the image is transferred onto the sheet of paper P and fixed. Therefore, image forming apparatus 1A includes an image forming unit 14 having the photoreceptor drum 3, a transfer mechanism 10 for directly or indirectly transferring the toner image formed on the surface of photoreceptor drum 3 to the sheet of paper P, and a fixing unit 6 for fixing the toner image transferred to the sheet of paper P on the sheet of paper P.

Image forming apparatus 1A further includes: a sheet containing unit 8 with multi-stage paper feed cassettes 1000, 1002 and 1004 capable of storing a plurality of sheets of paper P in a stacked state; a sheet feeding unit 59 for feeding a sheet of paper P supplied from cassette 1000, 1002 or 1004 to image forming unit 14; and a sheet feeder 7 feeding a sheet of paper P on which a toner image has been transferred by transfer mechanism 10 to fixing unit 6.

Referring to FIG. 2, image forming apparatus 1A is formed of a body 1A1 of the apparatus, and an automatic document feeder 1A2.

On an upper surface of apparatus body 1A1, a platen 21 of transparent glass for receiving a document is provided. Automatic document feeder 1A2 is attached to apparatus body 1A1 to open/close platen 21.

Below the platen 21, a scanner unit 22 is provided for reading image information of the document. Below scanner unit 22, an exposure unit 1, a developer 2, photoreceptor drum 3, a charger 4, a neutralizer 41, a photoreceptor drum cleaning unit 5, fixing unit 6, sheet feeder 7, a discharge tray 9 and transfer mechanism 10 are arranged.

Figure 5:
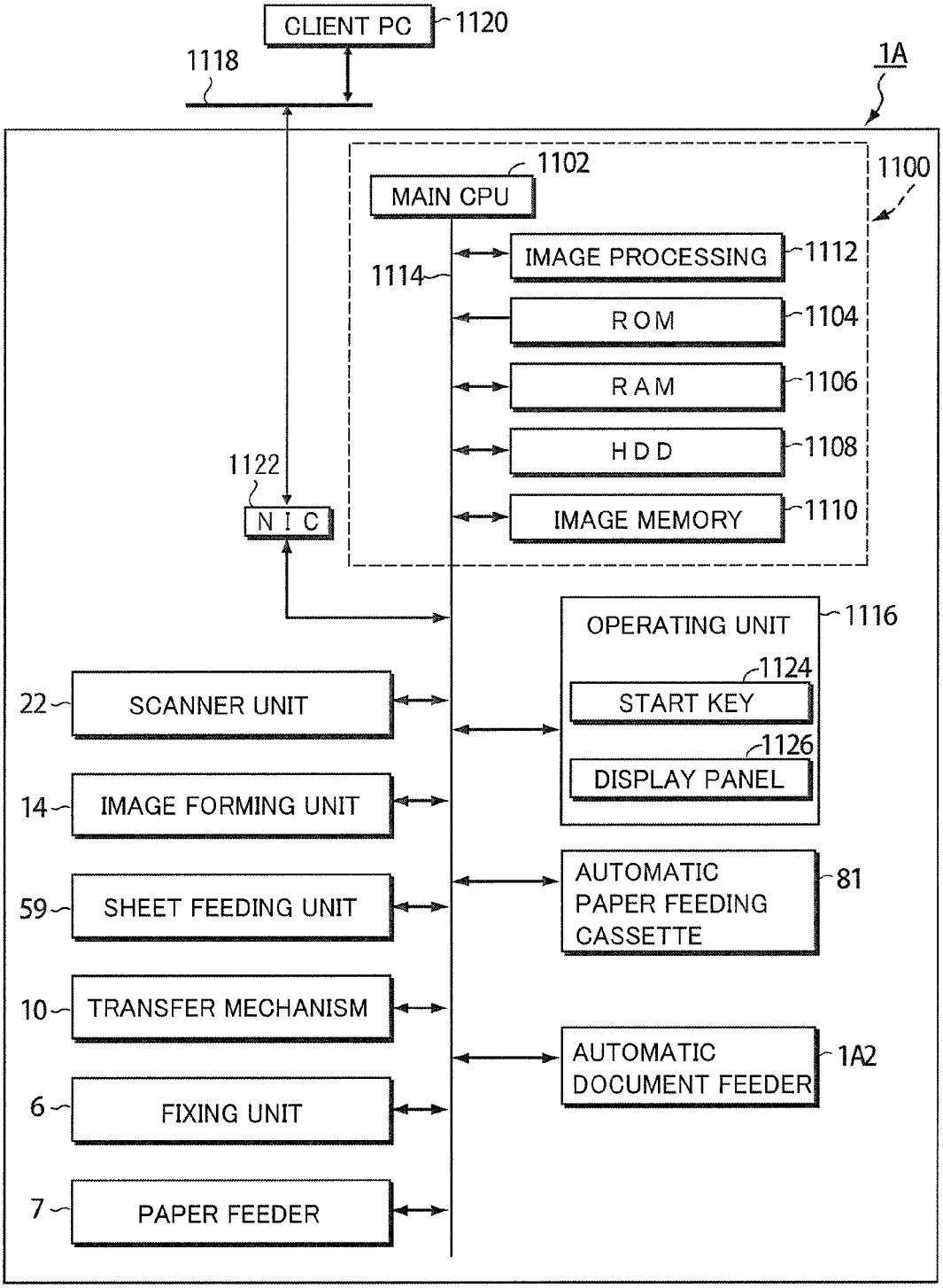
FIG. 5 is a block diagram showing a hardware configuration of the image forming apparatus shown in FIG. 2.

Exposure unit 1 irradiates a surface of photoreceptor drum 3 charged uniformly by charger 4 with a laser beam in accordance with the image data output from image processing unit 1112 shown in FIG. 5 for exposure, whereby a electrostatic latent image in accordance with the image data is formed on the surface of photoreceptor drum 3. Exposure unit 1 is arranged immediately below scanner unit 22 and above photoreceptor drum 3. Exposure unit 1 includes laser scanning units (hereinafter referred to as "LSUs") 13*a* and 13*b* with laser emitting units 11*a* and 11*b*, and reflection mirrors 12. In the present embodiment, for high-speed printing, two-beam technique is adopted, in which a plurality of laser beams are utilized to attain moderate emission timing. Though LSUs 13*a* and 13*b* are used in exposure unit 1 in the present embodiment, an array of light emitting elements such as EL (Electro Luminescence) or LED (Light Emitting Diode) write heads, for example, may be used.

Photoreceptor drum 3 is arranged below exposure unit 1. Photoreceptor drum 3 is controlled such that it rotates in a prescribed direction (direction of arrow A in FIGS. 2 and 3) by a driving device, not shown, and controller 1100 shown in FIG. 5.

Around photoreceptor drum 3, a sheet separating pawl 31, photoreceptor drum cleaning unit 5, charger 4, developer 2 and neutralizer 41 are arranged in this order along the direction of rotation of photoreceptor drum 3, with the position of toner image transfer being a reference, as shown in FIG. 3.

Sheet separating pawl 31 is arranged to be brought into contact with/separated from the outer circumferential surface of photoreceptor drum 3, by a solenoid 32. Sheet separating pawl 31 separates, in a state in contact with the outer circumferential surface of photoreceptor drum 3, the sheet of paper P adhered on the surface of photoreceptor drum 3 when the toner image formed on the surface of photoreceptor drum 3 is transferred to the sheet of paper P. In place of solenoid 32, a driving motor or the like may be used as the device for driving sheet separating pawl 31, or other driving device may be used.

Developer 2 visualizes the electrostatic latent image formed on the surface of photoreceptor drum 3 by black toner. Below developer 2 and upstream side of the sheet feeding unit 59 in the paper feeding direction, a register roller 15 is arranged.

A toner supply device 30 is arranged adjacent to developer 2. Toner supply device 30 stores toner, discharged from a toner container 300 filled with toner, temporarily in an intermediate hopper unit 33 and then supplies the toner to developer 2.

Charger 4 is arranged above photoreceptor drum 3, near the outer circumferential surface of photoreceptor drum 3. Charger 4 uniformly charges the surface of photoreceptor drum 3 to a prescribed potential. Though a non-contact type charger is used as charger 4 in the present embodiment, a contact type charger, such as a roller charger or a brush charger, may be used.

Neutralizer 41 lowers the surface potential of photoreceptor drum 3 so as to facilitate transfer of the toner image formed on the surface of photoreceptor drum 3 to the sheet of paper P. Though neutralizer having neutralizing electrode is used as neutralizer 41 in the present embodiment, one that utilizes a neutralizing lamp, or other type of neutralizer may be used.

Photoreceptor drum cleaning unit 5 removes and recovers the toner left on the surface of photoreceptor drum 3, after the transfer of toner image.

Transfer mechanism 10 transfers the toner image that has been visualized on the surface of photoreceptor drum 3 to the sheet of paper P by applying, to the fed sheet of paper P, transfer electric field of opposite polarity to the charges of the toner image. For instance, if the toner image has charges of (−) polarity, the polarity applied by transfer mechanism 10 is of (+) polarity.

Transfer mechanism 10 includes a driving roller 101, a driven roller 102, and a transfer belt 103 wound around rollers 101 and 102 and other rollers, and formed as a unit including these components. Belt 103 has a prescribed resistance value (in the present embodiment, $1\times10^{9}$ Ω·cm to $1\times10^{13}$ Ω·cm). Transfer mechanism 10 is arranged below photoreceptor drum 3 such that the surface of belt 103 is in contact with a part of outer circumferential surface of photoreceptor drum 3. In transfer mechanism 10, the sheet of paper P is fed pressed against photoreceptor drum 3 by means of belt 103.

Near the portion 104 at which photoreceptor drum 3 and belt 103 are in contact with each other, an elastic conductive roller 105, which has conductivity type different from that of rollers 101 and 102 and is capable of applying transfer electric field, is arranged.

Roller 105 is formed of a soft material such as elastic rubber or foamable resin. With roller 105 being elastic, the contact between photoreceptor drum 3 and belt 103 becomes a plane contact of a prescribed width, which is referred to as a transfer nip, rather than a line contact. This improves transfer efficiency of the toner image to the fed sheet of paper P.

On the downstream side of paper feeding direction than the transfer area of belt 103, a neutralizing roller 106 is arranged, on the back side of belt 103. Neutralizing roller 106 neutralizes the electric field applied to the fed sheet of paper P at the transfer area, to enable smooth feeding of the sheet of paper P to the next step.

As can be well seen in FIG. 3, in transfer mechanism 10, a transfer belt cleaning unit 107 for removing smudge of toner left on the surface of belt 103, and a plurality of neutralizing mechanisms 108 for neutralizing belt 103 are arranged. The neutralizing method applied to neutralizing mechanism 108 may be a method of grounding through the apparatus, or a method of positively applying an electric field having opposite polarity to the transfer electric field.

The toner image transferred to the sheet of paper P at transfer mechanism 10 is pressurized and heated at fixing unit 6, whereby the not-yet-fixed toner is melt and fixed on the sheet of paper P.

In fixing unit 6, the not-yet-fixed toner on the fed sheet of paper P is heated and melt by a heating roller 6*a* at a portion 600 generally referred to as a fixing nip, where heating roller 6*a* and a pressurizing roller 6*b* are in pressure contact with each other, and by the function of pressure contact between rollers 6*a* and 6*b*, the melt toner is fixed on the sheet of paper P.

Near the outer circumferential surface of roller 6*a*, a paper separation pawl 611, a thermister 612 and a heating roller cleaning unit 613 for cleaning the outer circumferential surface of roller 6*a* are arranged. Inside the roller 6*a*, a heat source 614 is provided, to heat the surface of roller 6*a* to a prescribed temperature (set fixing temperature: approximately 160° C. to approximately 200° C.).

Near the opposite ends in the longitudinal direction of roller 6*b*, pressurizing members 621 are arranged to enable pressure contact of roller 6*b* to roller 6*a* with a prescribed pressure. Near the outer circumferential surface of roller 6*b*, a paper separation pawl 622 and a pressurizing roller surface cleaning unit 623 are arranged, as in the vicinity of roller 6*a*.

Near the fixing unit 6, a conveyor roller 16 is provided, for feeding the sheet of paper P from the inside to the outside of fixing unit 6. On the downstream side in the paper feeding direction of roller 16, a discharge roller 17 is provided for discharging the sheet of paper P to discharge tray 9.

Multi-stage paper feed cassettes 1000, 1002 and 1004 are to store a plurality of sheets of paper P of mutually different sizes, as shown in FIG. 2. Cassettes 1000, 1002 and 1004 are arranged below image forming unit 14 that includes exposure unit 1, developer 2, photoreceptor drum 3, charger 4, neutralizer 41, photoreceptor drum cleaning unit 5 and fixing unit 6.

Sheet feeding unit 59 includes first to third paper feeding systems for feeding the sheet of paper P to a paper feed path from cassettes 1000, 1002 and 1004 to image forming unit 14.

The first paper feeding system includes a pick-up roller 1006 for feeding the sheets of paper P in the uppermost, first paper feed cassette 1000 one by one to the paper feed path, and a paper feed roller 1008 and a separation roller 1010 forming a vertical pair and serving as retard rollers. The first paper feeding system picks-up the sheets of paper stored stacked in cassette 1000 one by one from the uppermost layer, and feeds to the paper feed path, by the rotations of rollers 1006, 1008 and 1010. Rollers 1006, 1008 and 1010 are arranged at an end portion of paper discharging side of cassette 1000. The sheet of paper P fed from the inside of cassette 1000 to the paper feed path by the operations of rollers 1006, 1008 and 1010 is transmitted to a register roller 15 positioned at the terminal end in the feeding direction of paper feed path, by the rotations of a plurality of conveyor roller pairs on the way.

The second paper feeding system includes a pick-up roller 1012 for feeding the sheets of paper P in the middle, second paper feed cassette 1002 one by one to the paper feed path, and a paper feed roller 1014 and a separation roller 1016 forming a vertical pair and serving as retard rollers. The second paper feeding system picks-up the sheets of paper stored stacked in cassette 1002 one by one from the uppermost layer, and feeds to the paper feed path, by the rotations of rollers 1012, 1014 and 1016. Rollers 1012, 1014 and 1016 are arranged at an end portion of paper discharging side of cassette 1002. The sheet of paper P fed from the inside of cassette 1002 to the paper feed path by the operations of rollers 1012, 1014 and 1016 is transmitted to a resist roller 15 positioned at the terminal end in the feeding direction of paper feed path, by the rotations of the plurality of conveyor roller pairs on the way.

The third paper feed system includes a pick-up roller 1018 for feeding the sheets of paper P in the lowermost, third paper feed cassette 1004 one by one to the paper feed path, and a paper feed roller 1020 and a separation roller 1022 forming a vertical pair and serving as retard rollers. The third paper feeding system picks-up the sheets of paper stored stacked in cassette 1004 one by one from the uppermost layer, and feeds to the paper feed path, by the rotations of rollers 1018, 1020 and 1022. Rollers 1018, 1020 and 1022 are arranged at an end portion of paper discharging side of cassette 1004. The sheet of paper P fed from the inside of cassette 1004 to the paper feed path by the operations of rollers 1018, 1020 and 1022 is transmitted to a register roller 15 positioned at the terminal end in the feeding direction of paper feed path, by the rotations of the plurality of conveyor roller pairs on the way.

Register roller 15 has its operation controlled by a driving device, not shown, and controller 1100 shown in FIG. 5, such that a sheet of paper P fed from each of cassettes 1000, 1002 and 1004 is fed between photoreceptor drum 3 and belt 103 with tip end of the sheet aligned with the toner image formed on the surface of photoreceptor drum 3.

Image forming apparatus 1A performs high speed printing and, therefore, cassette 1000 is adapted to contain 500 to 1500 sheets of regular size paper. Therefore, in the present embodiment, of the three paper feeding systems described above, the first paper feeding system including rollers 1006, 1008 and 1010 is adapted to have inventive characteristic, of which contents will be described later in detail.

To one side surface of apparatus body 1A1 (on the right side surface in FIG. 2), an automatic paper feeding cassette 81 is connected, which is capable of storing sheets of paper of different types in large volume. Above the cassette 81, a manual feed tray 82 is provided mainly for handling sheets of paper of irregular size. From cassette 81 and tray 82 also, sheet of paper P is fed to image forming unit 14 through the paper feed path.

Discharge tray 9 is arranged on a side surface opposite to the side where the tray 82 is provided. Image forming apparatus 1A may have a post processing device for stapling or punching of the discharged sheets, a multi-stage discharge tray or the like arranged as an optional component, in place of tray 9.

Sheet feeder 7 is arranged between photoreceptor drum 3 and cassettes 1000, 1002 and 1004 described above. Sheet feeder 7 is provided with the paper feed path, a branching pawl and the like. Sheet feeder 7 has functions of feeding sheets of paper P supplied from cassettes 1000, 1002 and 1004 one by one to transfer mechanism 10, feeding the sheet of paper P on which the toner image is transferred from photoreceptor drum 3 by transfer mechanism 10 to fixing unit 6, and after the toner image is transferred by fixing unit 6, feeding the sheet in accordance with a designated paper discharge mode.

In image forming apparatus 1A, a one-sided printing mode and a two-sided printing mode are set in advance as the discharge modes. In the one-sided printing mode, it is possible to selectively set either a face-up discharging in which the sheet of paper P is discharged with the printed side facing upward or a face-down discharging in which the sheet of paper P is discharged with the printed side facing downward.

<Driving Mechanism 1024 for the First Paper Feeding System at Sheet Feeding Unit 59>

Figure 4:
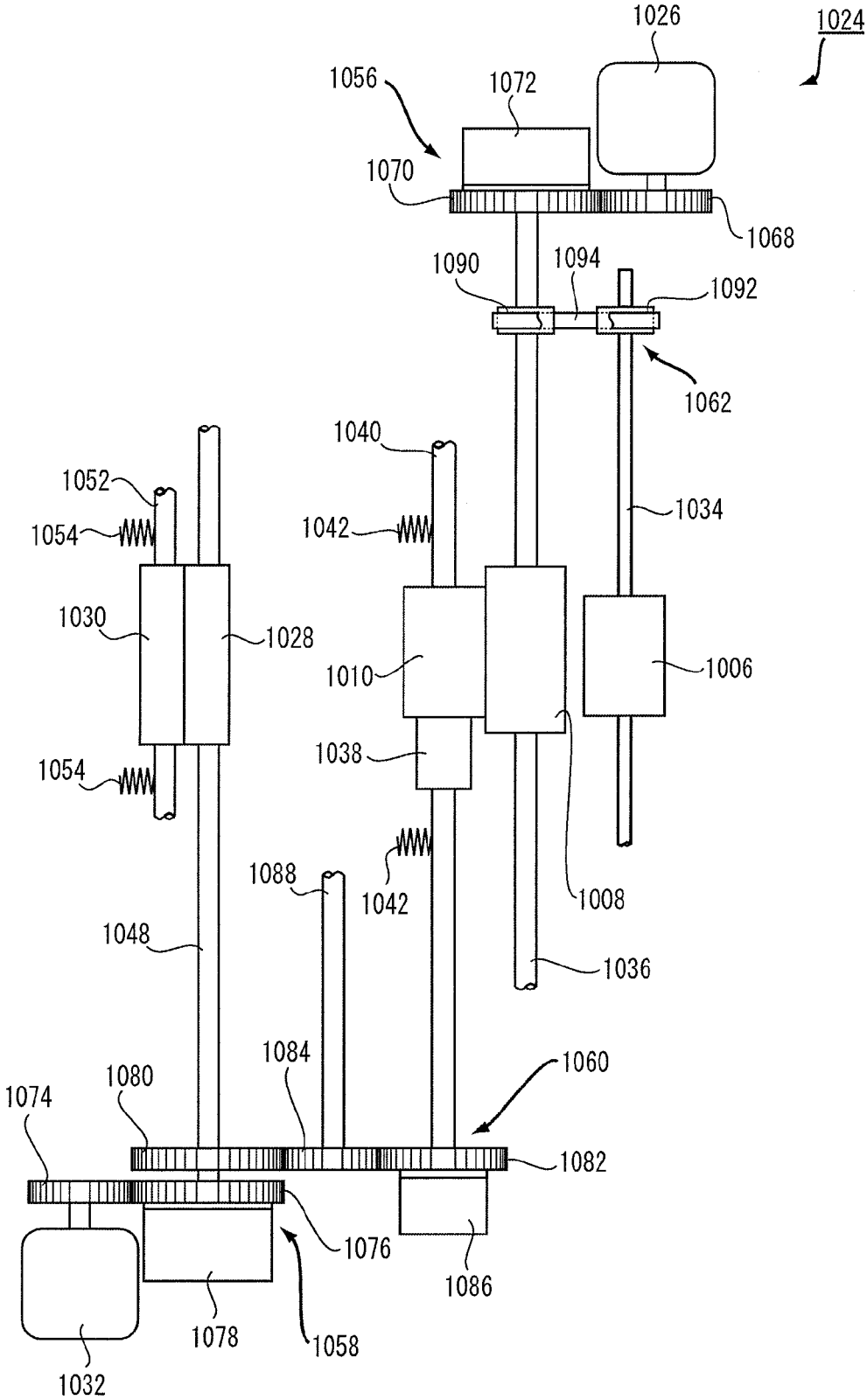
FIG. 4 is a development showing a structure of a driving mechanism for a first paper feed system of a sheet feeding unit.

Referring to FIG. 4, in a driving mechanism 1024 of the first paper feeding system at sheet feeding unit 59, a paper feed roller motor 1026 is used as a driving source of rollers 1006 and 1008. Further, as the driving source of conveyor rollers 1028 and 1030 positioned downstream side of rollers 1008 and 1010 in the feeding direction, a conveyor roller motor 1032 is used. Motor 1032 is also used as a driving source of roller 1010.

Roller 1006 is supported by a pick-up roller shaft 1034. Shaft 1034 is rotatably supported on a bracket in apparatus body 1A1 by a bearing, not shown.

Roller 1008 is arranged with a prescribed space on the downstream side of roller 1006 in the feeding direction, and supported by a paper feed roller shaft 1036. Shaft 1036 is rotatably supported on a bracket in apparatus body 1A1 by a bearing, not shown.

Roller 1010 is arranged below and opposite to roller 1008. Roller 1010 is supported by a separation roller shaft 1040 with a torque limiter 1038 generating a prescribed torque interposed. Shaft 1040 is rotatably supported on a bracket in apparatus body 1A1 with a bearing, not shown, interposed, and urged toward upper roller 1008 by first pressurizing springs 1042 forming a pair on the right and left of roller 1010. Consequently, roller 1010 comes to be in pressure contact with roller 1008 as a counterpart of the pair, with a prescribed retard pressure.

Torque value and retard pressure of torque limiter 1038 and springs 1042 are set such that roller 1010 is driven following roller 1008 by frictional force when there is no sheet or there is only one sheet at a nip where the rollers 1008 and 1010 are in pressure contact with each other. Further, the torque value and retard pressure are set such that roller 1010 is rotated in reverse direction to generate a sheet returning force when there is two or more sheets at the nip.

Rollers 1028 and 1030 are arranged with a prescribed space on the downstream side of rollers 1008 and 1010 in the feeding direction. Roller 1028 is supported by a driving side conveyor roller shaft 1048. Shaft 1048 is rotatably supported on a bracket in apparatus body 1A1 with a bearing, not shown, interposed. Roller 1030 is arranged below and opposite to roller 1028, and supported by a driven side conveyor roller shaft 1052. Shaft 1052 is rotatably supported on a bracket in apparatus body 1A1 by a bearing, not shown, urged toward upper roller 1028 by second pressurizing springs 1054 forming a pair on the right and left of roller 1030. Consequently, roller 1030 comes to be in pressure contact with roller 1028 as a counterpart of the pair, with a prescribed retard pressure.

The present driving mechanism 1024 includes, in order to transmit the driving force of motor 1026 to shaft 1036, a first gear train 1056. Further, in order to transmit the driving force of motor 1032 to shaft 1048, the mechanism includes a second gear train 1058. Further, in order to transmit the rotational force of shaft 1048 to shaft 1040, the mechanism includes a third gear train 1060. Further, in order to transmit rotational force of shaft 1036 to shaft 1034, the mechanism includes a pulley device 1062.

Gear train 1056 includes a paper feed roller motor gear 1068 and a paper feed roller driving gear 1070 that rotates meshed with gear 1068. Gear 1068 is fitted on an output shaft of motor 1026. Gear 1070 is fitted on one end of shaft 1036, and further, it is connected to a paper feed roller clutch 1072. Clutch 1072 is an electromagnetic or electric clutch. Clutch 1072 brings gear 1070 to be in contact with/separated from gear 1068. When clutch 1072 is turned ON, gear 1070 is brought into contact with gear 1068, and the driving force of motor 1026 is transmitted through gears 1068 and 1070 to shaft 1036, whereby the shaft 1036 rotates. Consequently, roller 1008 rotates in a direction of feeding the sheet of paper P. On the other hand, when clutch 1072 is turned OFF, gear 1070 is separated from gear 1068 and transmission of driving force of motor 1026 is stopped and, therefore, shaft 1036 does not rotate. Thus, rotation of roller 1008 stops.

Gear train 1058 includes a conveyor roller motor gear 1074 and a first conveyor roller driving gear 1076 that rotates meshed with gear 1074. Gear 1074 is fitted on an output shaft of motor 1032. Gear 1076 is fitted on one end of shaft 1048, and further, it is connected to conveyor roller clutch 1078. Clutch 1078 is an electromagnetic or electric clutch. Clutch 1078 brings gear 1076 to be in contact with/separated from gear 1074. When clutch 1078 is turned ON, gear 1076 is brought into contact with gear 1074, and the driving force of motor 1032 is transmitted through gears 1074 and 1076 to shaft 1048, whereby the shaft 1048 rotates. Consequently, roller 1028 rotates in a direction of feeding the sheet of paper P. Here, as the roller 1028 is in pressure contact with roller 1030, roller 1030 rotates, following roller 1028. On the other hand, when clutch 1078 is turned OFF, gear 1076 is separated from gear 1074 and transmission of driving force of motor 1032 is stopped and, therefore, shaft 1048 does not rotate. Thus, rotation of rollers 1028 and 1030 stops.

Gear train 1060 includes a second conveyor roller driving gear 1080, a separation roller driving gear 1082, and an intermediate gear 1084 that rotates meshed with both gears 1080 and 1082. Gear 1080 is fitted on the one end of shaft 1048 inside of gear 1076. Gear 1082 is fitted on one end of shaft 1040 and further, connected to a separation roller clutch 1086. Clutch 1086 is an electromagnetic or electric clutch. Clutch 1086 brings gear 1082 to be in contact with/separated from gear 1084. Gear 1084 is fitted on one end of gear shaft 1088. Shaft 1088 is rotatably supported on a bracket in apparatus body 1A1 with a bearing, not shown, interposed. When clutch 1086 is turned ON, gear 1082 is brought into contact with gear 1084, and rotational force of shaft 1048 is transmitted through gears 1080, 1084 and 1082 to shaft 1040, whereby the shaft 1040 rotates. Consequently, roller 1010 rotates in a direction of returning the sheet of paper P. When the clutch 1086 is turned OFF, gear 1082 is separated from gear 1084, and transmission of rotational force of shaft 1048 is stopped and, therefore, the shaft 1040 comes to be in a free state. At this time, roller 1010 is in pressure-contact with roller 1008 and, therefore, it rotates in the positive direction of feeding the sheet of paper P, following roller 1008.

Pulley device 1062 includes a driving pulley 1090, a driven pulley 1092, and a pulley belt 1094 wound around pulleys 1090 and 1092. Pulley 1090 is fitted near one end of shaft 1036 inside of gear 1070. Pulley 1092 is fitted on one end of shaft 1034. Therefore, rotational force of shaft 1036 is transmitted through pulley 1090, pulley belt 1094 and pulley 1092 to shaft 1034. As a result, roller 1006 rotates in the direction of feeding the sheet of paper P in synchronization with roller 1008.

<Hardware Configuration>

Referring to FIG. 5, image forming apparatus 1A includes a controller 1100 for overall control of image forming apparatus 1A.

Controller 1100 is substantially a computer, including a main CPU 1102, an ROM 1104, an RAM 1106, an HDD (Hard Disk Drive) 1108, an image memory 1110 and an image processing unit 1112.

A common BUS line 1114 is connected to main CPU 1102 and, to the common BUS line 1114, ROM 1104, RAM 1106, HDD 1108, image memory 1110 and image processing unit 1112 are connected.

Figure 6:
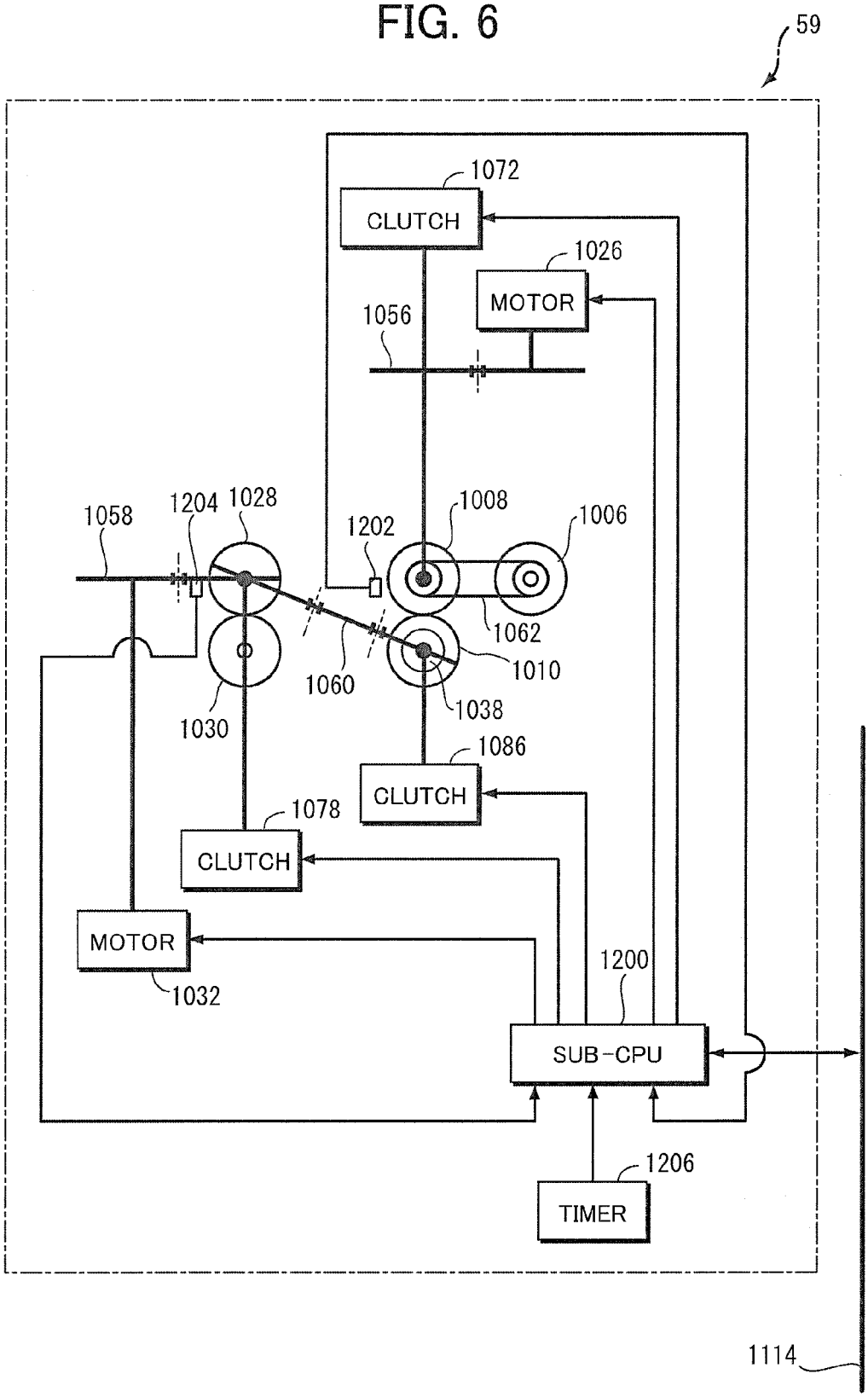
FIG. 6 is a block diagram showing an electrical configuration of the sheet feeding unit.

Main CPU 1102 realizes the function of sheet feeding unit 59 shown in FIG. 6, by executing a computer program for realizing the paper feeding process in accordance with the present embodiment. The program to be executed by main CPU 1102 is stored in ROM 1104 or HDD 1108.

The program stored in ROM 1104 or HDD 1108 is read from ROM 1104 or HDD 1108 at the time of execution and stored in RAM 1106, read from an address in RAM 1106 indicated by a register functioning as a program counter in main CPU 1102, and interpreted and executed by main CPU 1102. Data necessary for execution are read from a register in main CPU 1102, RAM 1106 or HDD 1108 at an address designated by the instruction. Similarly, the result of execution is stored in register in main CPU 1102, RAM 1106 or HDD 1108 at an address designated by the instruction.

To the common BUS line 1114, also connected are a scanner unit 22, image forming unit 14, sheet feeding unit 59, transfer mechanism 10, fixing unit 6, sheet feeder 7, automatic feeding cassette 81, automatic document feeder 1A2, operating unit 1116 of image forming apparatus 1A, and an NIC (Network Interface Card) 1122 serving as an interface to client PC 1120 or the like as an external device through a LAN (Local Area Network) line 1118. Therefore, main CPU 1102 controls scanner unit 22, image forming unit 14, sheet feeding unit 59, transfer mechanism 10, fixing unit 6, sheet feeder 7, automatic feeding cassette 81, automatic document feeder 1A2, and NIC 1122 to cause these components execute desired operations such as document reading, document output, feeding and discharge of sheets, and communication with an external device such as client PC 1120, stores data in or reads data from RAM 1106, HDD 1108 and image memory 1110.

Operating unit 1116 is provided on a front surface of apparatus body 1A1. Operating unit 1116 is provided with a start key 1124, a display panel 1126 and the like.

The paper feed program in accordance with the present embodiment is transmitted from the external device to controller 1100 through LAN line 1118 and NIC 1122, and stored in ROM 1104 or HDD 1108.

<Electric Structure of Sheet Feeding Unit 59>

FIG. 6 shows only the first paper feeding system related to the first cassette 1000, of the sheet feeding unit 59.

Referring to FIG. 6, sheet feeding unit 59 includes a sub-CPU 1200 as a control nerve center of control of the sheet feeding unit 59.

Sub-CPU 1200 is connected to common BUS line 1114. Sub-CPU 1200 transmits/receives various data to/from main CPU 1102 shown in FIG. 5, through common BUS line 1114. Sub-CPU 1200 is connected to motors 1026 and 1032, clutches 1072, 1078 and 1086, as well as to paper feed sensor 1202, conveyor sensor 1204 and a timer 1206.

As sensors 1202 and 1204, a reflective photo-interrupter is used, which detects passage of an object in a non-contact manner. Sensor 1202 is for detecting passage of the sheet of paper P through a nip where rollers 1008 and 1010 functioning as retard rollers are in pressure-contact with each other. Sensor 1202 is arranged close to roller 1008 on the downstream side of roller 1008 in the feeding direction. Sensor 1204 is for detecting passage of the sheet of paper P through a nip where rollers 1028 and 1030 are in pressure-contact with each other. Sensor 1204 is arranged close to roller 1028 on the downstream side of roller 1028 in the feeding direction.

To sub-CPU 1200, sensing outputs of sensors 1202 and 1204, and a timer output of timer 1206 are applied. Based on the received sensing outputs of sensors 1202 and 1204, the output of timer 1206 and the like, sub-CPU 1200 controls driving of motors 1026 and 1032 and clutches 1072, 1078 and 1086.

In the present embodiment, sheet feeding unit 59 and controller 1100 function as the paper feeder.

<Software Configuration>

Image forming apparatus 1A is programmed such that, if presence of a sheet is once detected by sensor 1202 as a result of a paper feeding operation and then, because of a subsequent separating operation, presence of the sheet comes to be no longer detected, a number of paper feed operations (in the present embodiment, three times) are performed as re-trial, rather than making a determination of paper jam before reaching sensor 1204.

Such a program is stored in ROM 1104 or HDD 1108 of controller 1100, and realizes various functions of image forming apparatus 1A as will be described in the following. These functions are realized by main CPU 1102 in controller 1100 and sub-CPU 1200 in sheet feeding unit 59, which are substantially computers, executing the program mentioned above.

Figure 7:
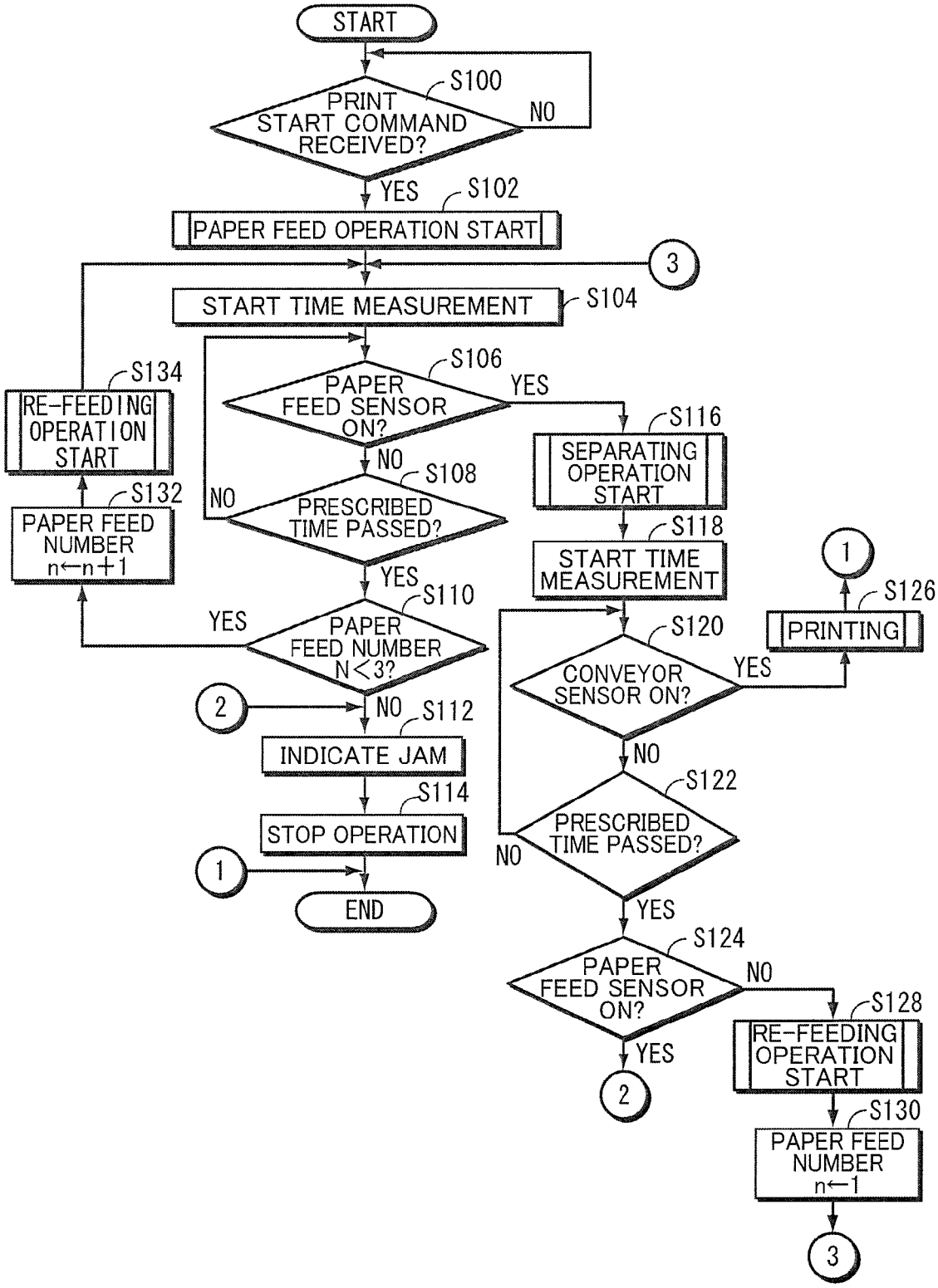
FIG. 7 is a flowchart representing a program structure for realizing the paper feed function of the image forming apparatus shown in FIG. 2.

The program of FIG. 7 shows a control flow assuming an overlapped feeding with a lower sheet protruded to the downstream side of the feeding direction than the upper sheet.

In image forming apparatus 1A, main CPU 1102 receives an ON operation signal of start key 1124, or a print start signal from an external device such as client PC 1120, and transmits a print start command to sub-CPU 1200.

Referring to FIG. 7, sub-CPU 1200 waits for transmission of the print start command from main CPU 1102 (step 100). Receiving the print start command from main CPU 1102, control of sub-CPU 1200 proceeds to step 102.

When control proceeds to step 102, sub-CPU 1200 executes a paper feed operation starting process.

The paper feed operation starting process will be described in detail.

Figure 8:
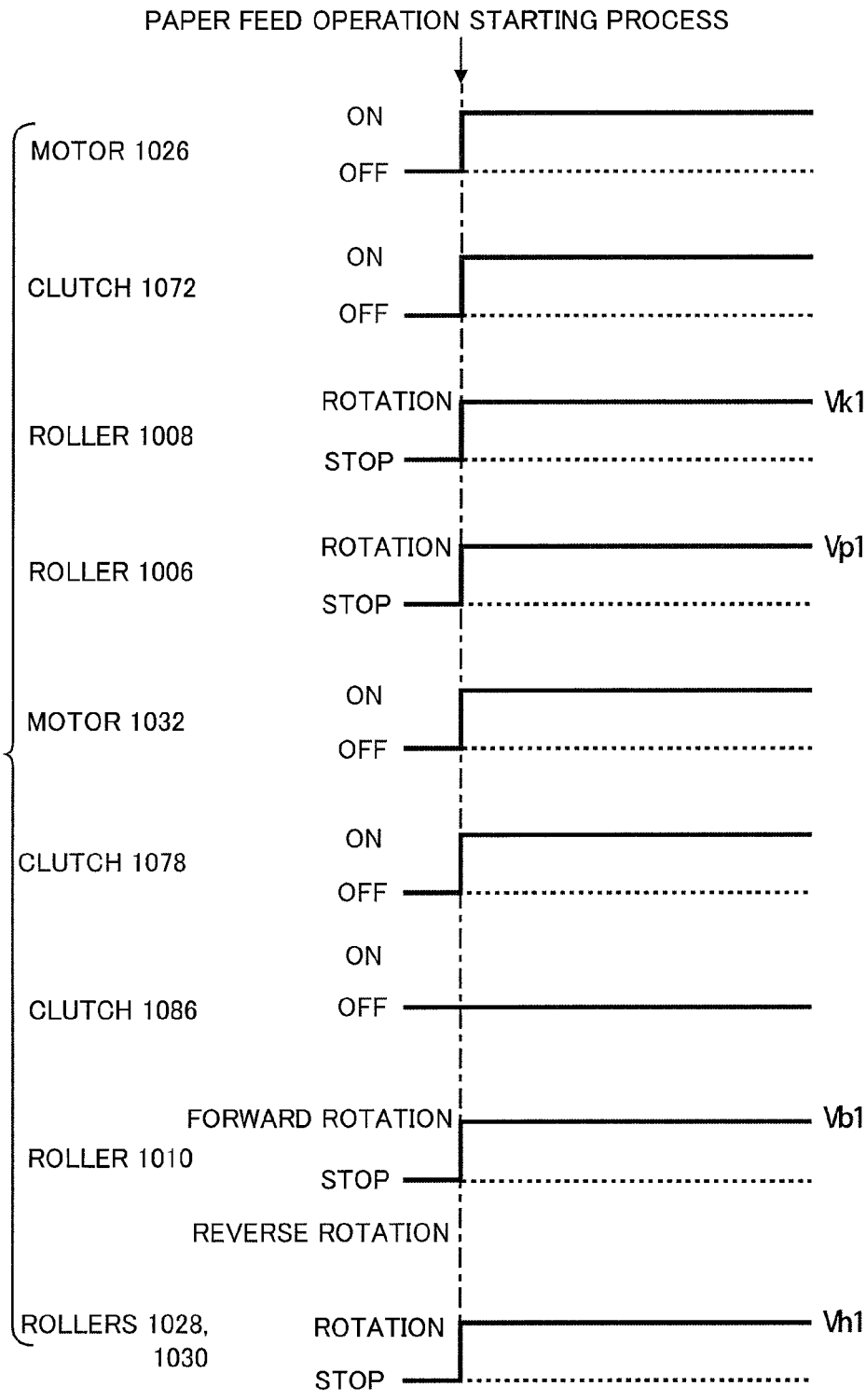
FIG. 8 is a time-chart of the program structure of a routine for realizing a paper feed operation starting function.

Referring to FIG. 8, for executing the paper feed operation starting process, sub-CPU 1200 turns ON motors 1026 and 1032, and turns ON clutches 1072 and 1078. Then, gear 1070 comes to be in contact with gear 1068, and shaft 1036 rotates. Together with the rotation of shaft 1036, pulley device 1062 operates and shaft 1034 rotates. As a result, rollers 1008 and 1006 start rotation in the direction of feeding the sheet of paper P. At this time, shaft 1040 is in a free state, and torque limiter 1038 integrated with shaft 1040 does not operate. Therefore, roller 1010 rotates following the rotation of roller 1008, in the direction of feeding the sheet of paper P (forward rotation). At the same time, conveyor roller driving gear 1076 is brought into contact with gear 1074 and shaft 1048 rotates. Then, rollers 1028 and 1030 start rotation in the direction of feeding the sheet of paper P.

Again referring to FIG. 7, when the paper feed operation starting process ends, sub-CPU 1200 sets timer 1206 ON to start time measurement (step 104). Then, the control proceeds to steps 106 and 108.

When control proceeds to steps 106 and 108, sub-CPU 1200 monitors whether sensor 1202 turns ON or not before the lapse of a prescribed time period. If the sensor 1202 turns ON within the prescribed time period, that is, when it is determined that sensor 1202 once turns ON as the lower sheet is fed to the downstream side of feeding direction by the paper feeding operation of rollers 1006, 1008 and 1010 and the tip end of the sheet protrudes from the nip formed by rollers 1008 and 1010, sub-CPU 1200 turns the timer 1206 OFF and executes a separating operation starting process (step 116).

Here, the separating operation starting process will be described in detail.

Figure 9:
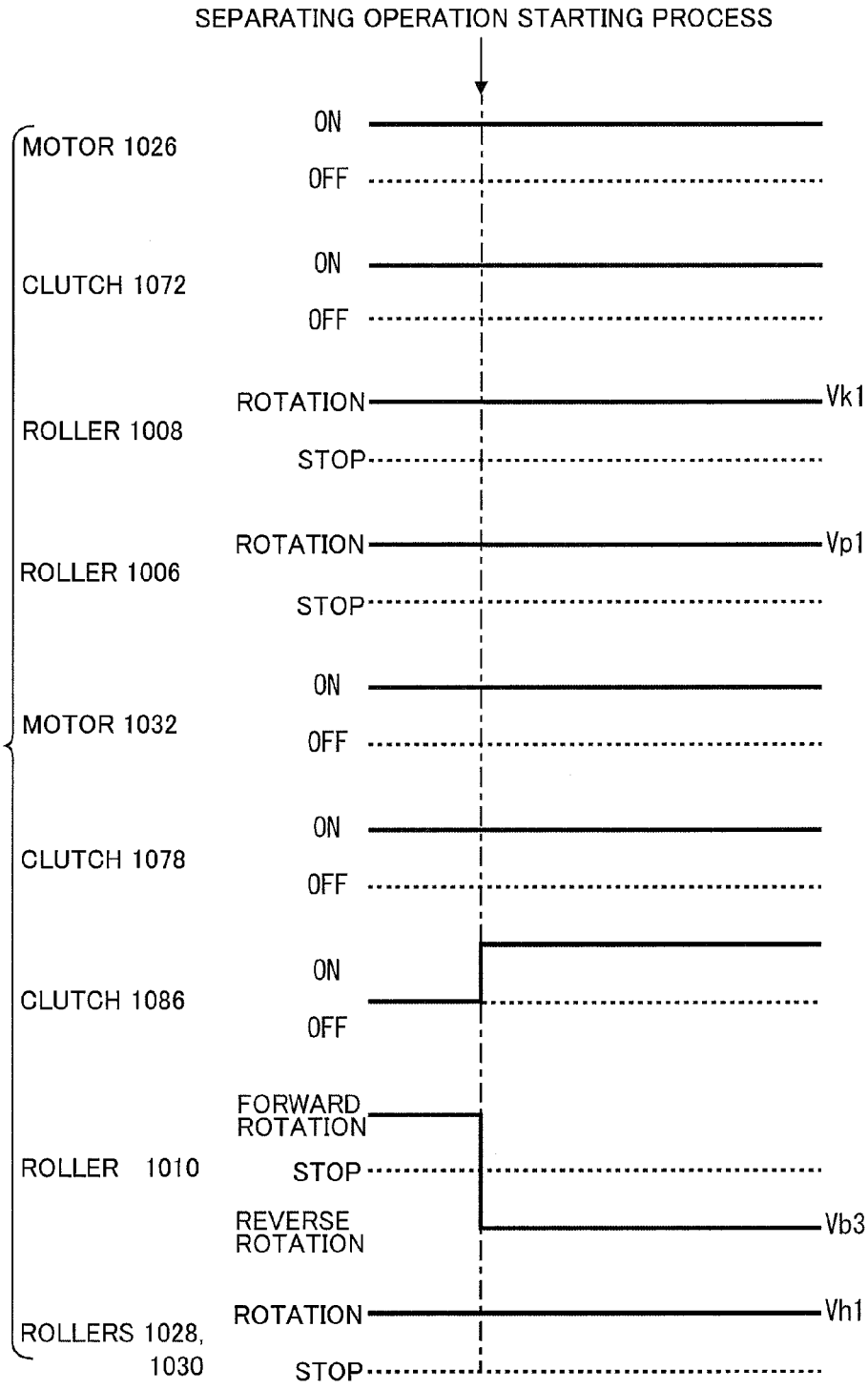
FIG. 9 is a time-chart of the program structure of a routine for realizing a separating operation starting function.

Referring to FIG. 9, for executing the separating operation starting process, sub-CPU 1200 turns ON clutch 1086. Then, gear 1082 comes to be in contact with gear 1084, and rotational force of shaft 1048 is transmitted through gears 1080, 1084 and 1082 to shaft 1040. At this time, there are two sheets of paper P at the nip formed by rollers 1008 and 1010 and torque limiter 1038 is in operation and, therefore, roller 1010 rotates in a direction of returning the sheets of paper P (reverse rotation).

It is preferred that, by decreasing the speed of rotation Vk1 of roller 1008 to be lower than the speed of rotation Vh1 of roller 1028 on the downstream side of feeding direction in the separating operation, speed of rotation Vb3 of reverse rotation of roller 1010 is made faster than the speed of rotation Vk1 of paired roller 1008. By setting speed of rotation of rollers 1008, 1010 and 1028 in this manner, a time lag from the overlapped feeding of sheets of paper P to the nip formed by rollers 1008 and 1010 to the start of reverse rotation of roller 1010 can be made shorter.

Again referring to FIG. 7, when the separating operation starting process ends, sub-CPU 1200 turns ON timer 1206 to start time measurement (step 118). Thereafter, control proceeds to steps 120 and 122.

When control proceeds to steps 120 and 122, sub-CPU 1200 monitors whether the sensor 1204 turns ON before the lapse of a prescribed time period or not.

When sensor 1204 turns ON before the lapse of the prescribed time period, sub-CPU 120 determines that a sheet of paper P has been normally fed to the paper feed path, and transmits a signal representing the normal feeding to main CPU 1102. Receiving the signal, main CPU 1102 controls image forming unit 14, transfer mechanism 10, fixing unit 6, sheet feeder 7 and the like so that the printing process is executed (step 126). After the end of the printing process, main CPU 1102 terminates the present paper feed control.

On the contrary, if sensor 1024 does not turn ON even after the lapse of the prescribed time period, sub-CPU 1200 determines whether sensor 1202 is kept ON or not (step 124). If sensor 1202 has been kept ON, sub-CPU 1200 determines that there is a paper jam occurring between rollers 1008 and 1010, and transmits a signal indicating the jam to main CPU 1102. Receiving the signal, main CPU 1102 provides a jam display indicating occurrence of a paper jam between rollers 1008 and 1010, on display panel 1126 (step 112). Thereafter, main CPU 1102 stops the operation of image forming apparatus 1A (step 114), and ends the present paper feed control. On the other hand, if the sensor 1202 is OFF, sub-CPU 1200 determines that the lower sheet that turned ON the sensor 1202 has been returned to the upstream side in the feeding direction and whereby the sensor 1202 has been turned off, and executes a re-feeding operation starting process (step 128).

Here, the re-feeding operation starting process will be described in detail.

Figure 10:
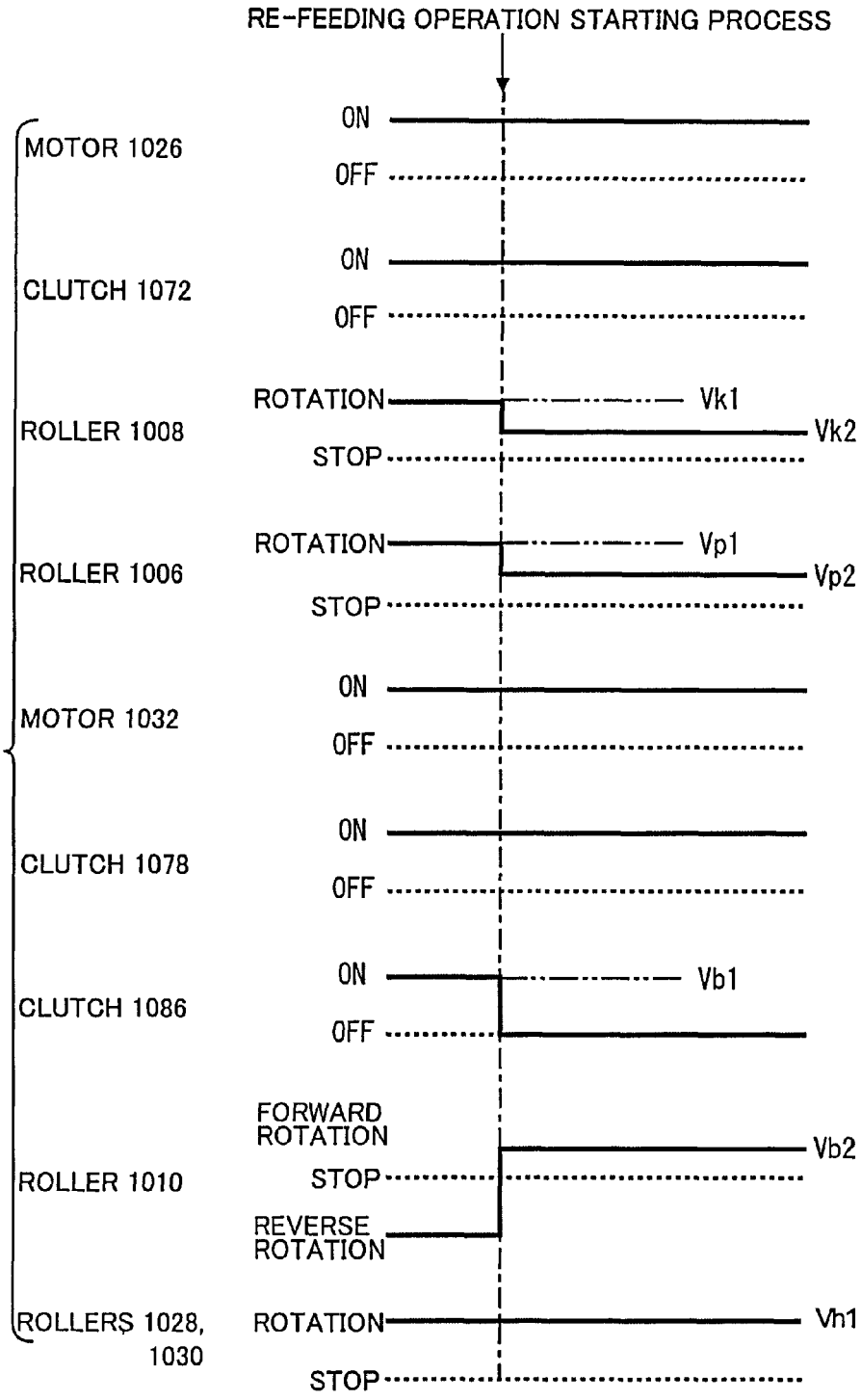
FIG. 10 is a time-chart of the program structure of a routine for realizing a re-feeding operation starting function.

Referring to FIG. 10, for executing the re-feeding operation starting process, sub-CPU 1200 turns OFF clutch 1086. Then, gear 1082 is separated from gear 1084, and transmission of rotational force of shaft 1048 to shaft 1040 is stopped. As a result, shaft 1040 comes to be in a free state, and roller 1010 again starts to rotate in the direction of feeding the sheet of paper P (forward rotation), following roller 1008.

The speed of rotation of roller 1008 in the re-feeding operation is preferably set to Vk2 slower than the speed of rotation Vk1 in the paper feeding operation (in the present embodiment, Vk2 is slower by about 3% to 5% than Vk1). Consequently, speed of rotation of roller 1006 also attains to Vp2 that is slower than the speed of rotation Vp1 in the feeding operation, and speed of rotation of roller 1010 also attains to Vb2 that is slower than the speed of rotation Vb1 in the feeding operation.

Again referring to FIG. 7, when the re-feeding operation starting process described above ends, sub-CPU 1200 assigns "1" to the number of paper feeding n, and stores it in a prescribed storage area in RAM 1106, through main CPU 1102 (step 130). Thereafter, the control returns to steps 104 to 108.

When the control is returned to steps 104 to 108, sub-CPU 1200 monitors whether the sensor 1202 turns ON before the lapse of a prescribed time period from the start of time measurement by timer 1206 or not.

When sensor 1202 turns ON within the prescribed time period, that is, when it is determined that sensor 1202 is turned ON as the upper sheet is fed to the downstream side of the feeding direction by the re-feeding operation of rollers 1006, 1008 and 1010 and the tip end of the sheet protrudes from the nip formed by rollers 1008 and 1010, sub-CPU 1200 turns OFF the timer 1206 at step 116, and again executes the separating operation starting process.

Then, at steps 118 to 122, if sensor 1204 turns ON before the lapse of the prescribed time period from the start of time measurement by timer 1206, it is determined by sub-CPU 1200 that the normal feeding state has been resumed, and the printing process takes place at step 126. Then the present paper feed control ends.

On the contrary, if the sensor 1202 does not turn ON within the prescribed time period, sub-CPU 1200 determines that the above-described paper feed condition is not yet resolved, and determines whether the number of paper feeding, which represents the number of executed re-feeding operations, has reached "3" or not (step 110). If the number of executed re-feeding operations has not yet reached 3, sub-CPU 1200 assigns "n+1" to the number of n of re-feeding operations, stores this in RAM 1106 through main CPU 1102, and then repeats the re-feeding operation starting process (steps 132 and 134). Thereafter, the control is returned to steps 104 to 108. On the other hand, if the above-described paper feed condition is not yet resolved even after repeating the re-feeding operations three times, sub-CPU 1200 determines that a paper jam occurred before reaching sensor 1204, and transmits a signal representing the jam to main CPU 1102. Receiving this signal, main CPU 1102 provides a jam display indicating a jam before reaching sensor 1204 on display panel 1126 (step 112). Thereafter, at step 114, the operation of image forming apparatus 1A is stopped, and the present paper feed control ends.

Further, if sensor 1204 does not turn ON and sensor 1202 turns OFF before the lapse of the prescribed time period from the start of separating operation at steps 118 to 122, it is determined by sub-CPU 1200 that the above-described paper feed condition occurred again, and the re-feeding operation is newly executed at step 128.

<Operation>

First, referring to FIG. 11, a basic operation will be described.

Figure 11A:
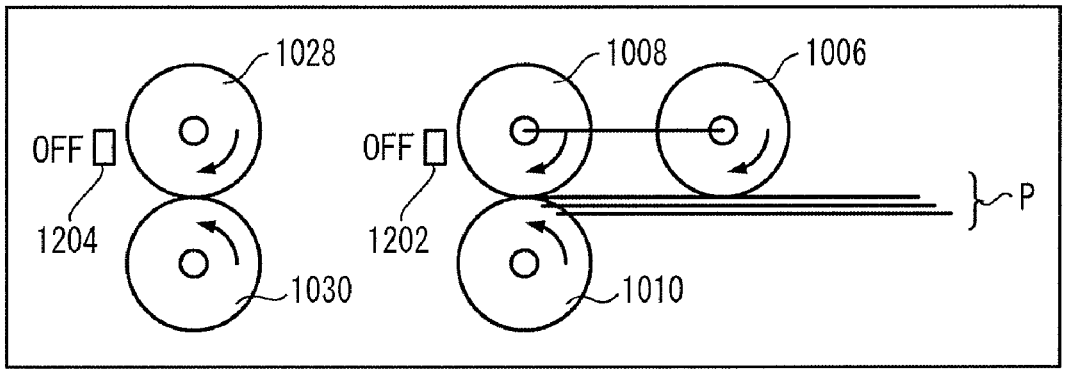
FIGS. 11A to 11C show a flow of a basic operation of the image forming apparatus shown in FIG. 2.
Figure 11B:
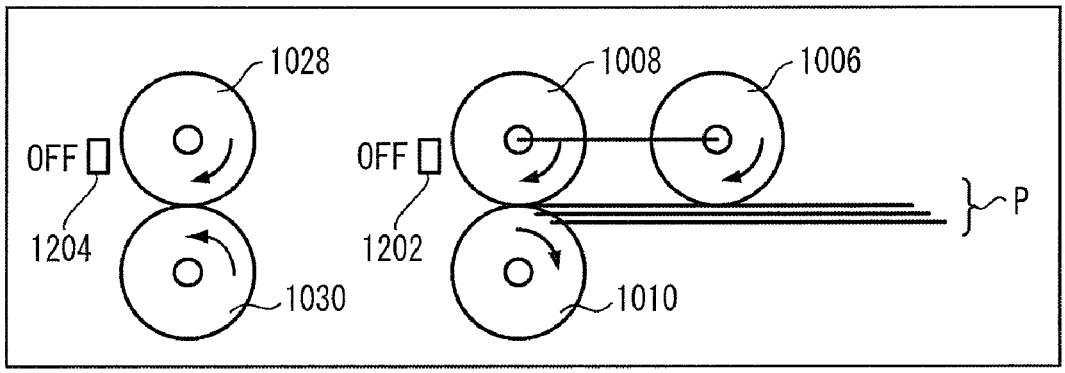
Figure 11C:
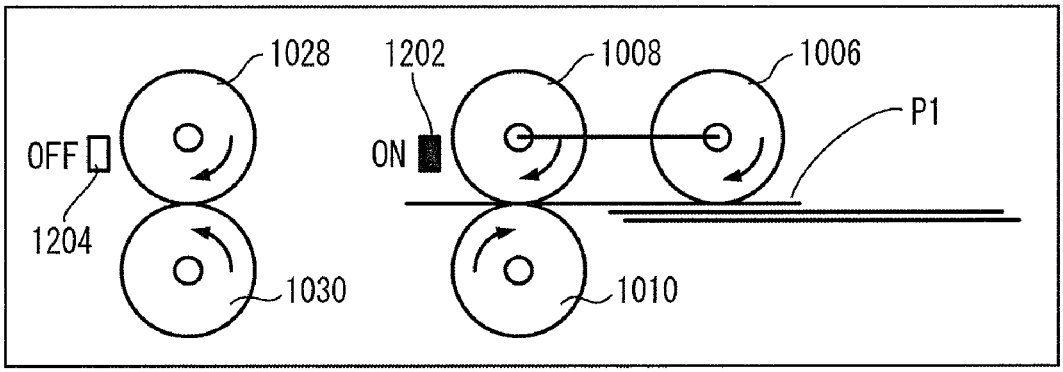

When a paper feed operation is executed by rotating roller 1006 and rollers 1008 and 1010 forming a vertical pair in the feeding direction (direction of feeding the sheet of paper) and rotating rollers 1028 and 1030 also in the feeding direction, it is sometimes possible that two or more sheets of paper P are fed in an overlapped manner. This state is shown in FIG. 11A.

When roller 1010 is rotated in the reverse feeding direction (direction of returning the sheet of paper) in this state, the first sheet from the top (uppermost layer) P1 is fed to the downstream side of feeding direction by roller 1008. On the other hand, the second and the following sheets from the top are returned to the upstream side of the feeding direction by roller 1010. As a result, the first sheet P1 is separated from the second and other sheets. At this time, sensor 1202 turns ON, and feeding of the tip end portion of the first sheet P1 from the nip between rollers 1008 and 1010 to the rollers 1028 and 1030 is detected. Specifically, the state of FIG. 11B changes to that of FIG. 11C.

Thereafter, when the first sheet P1 from the top passes through rollers 1028 and 1030 and the tip end of the sheet turns the sensor 1204 ON, it is determined that the first sheet has been normally fed, and the sheet P1 is subjected to the printing process.

Next, referring to FIGS. 12 and 13, an operation unique to the present embodiment will be described.

Figure 12A:
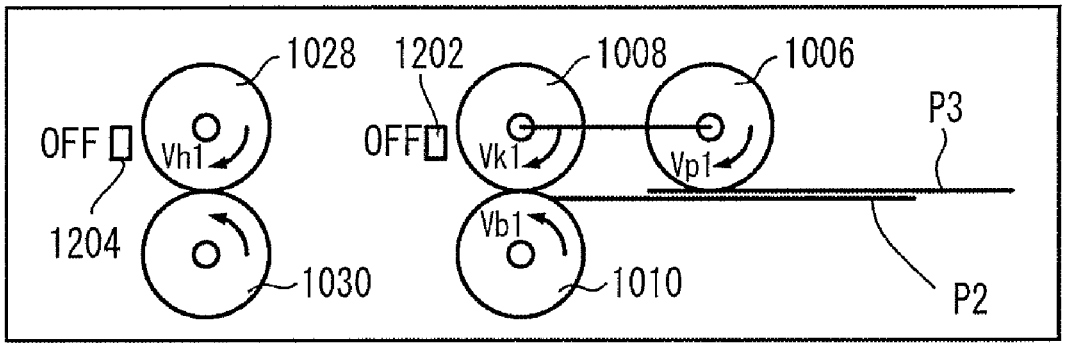
FIGS. 12A to 12F, 13A and 13B show flows of operations unique to the image forming apparatus shown in FIG. 2.
Figure 12B:
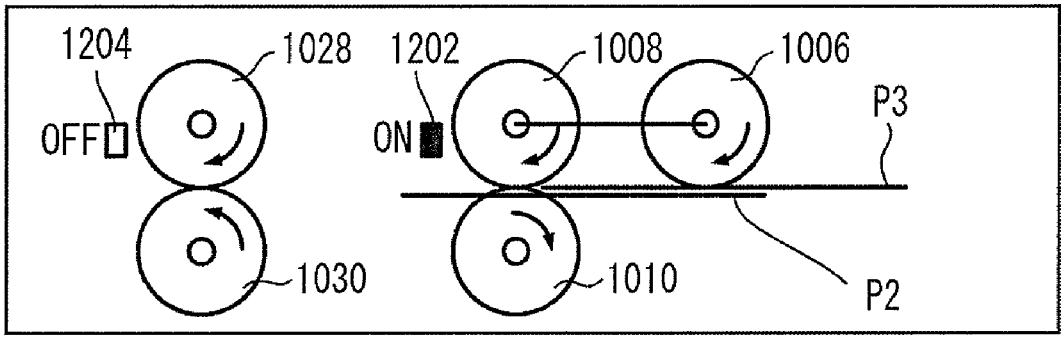
Figure 12C:
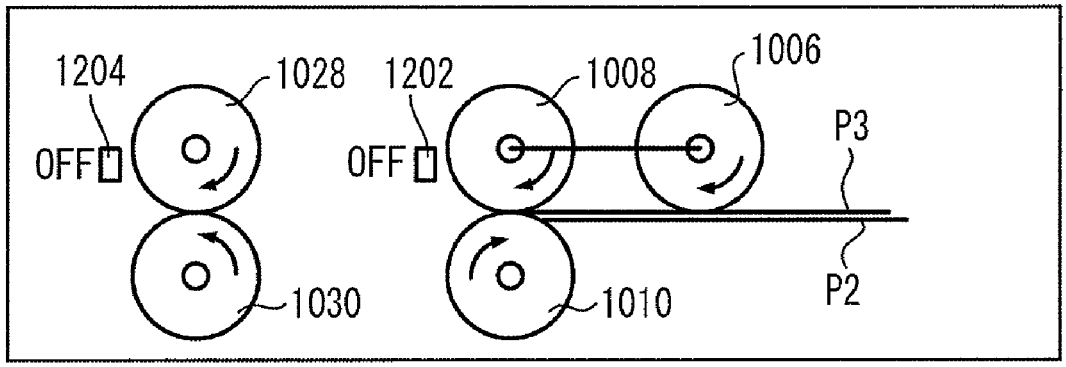

When a paper feed operation is executed by rotating roller 1006 and rollers 1008 and 1010 forming a vertical pair in the feeding direction and rotating rollers 1028 and 1030 also in the feeding direction, it is sometimes possible that sheets of paper are fed in an overlapped manner with a tip end of a lower sheet of paper P2 protruding to the rollers 1008 and 1010 functioning as retard rollers than the tip end of upper sheet of paper P3 (that is, lower sheet P2 goes ahead of upper sheet P3). In that case, by the paper feed operation, the lower sheet P2 is fed to the downstream side of the feeding direction so that its tip end protrudes from the nip formed by rollers 1008 and 1010, whereby the sensor 1202 is once turned ON. This state is shown in FIG. 12A.

In this state, if the roller 1010 is rotated in the reverse feeding direction to perform the separating operation, the lower sheet P2 is fed to the downstream side of the feeding direction by roller 1008, and its tip end protrudes from the nip formed by rollers 1008 and 1010. Thus, sensor 1202 is once turned ON. Thereafter, the lower sheet P2 that has turned ON the sensor 1202 is returned to the upstream side of the feeding direction by roller 1010, whereby sensor 1202 is turned OFF. Accordingly, sensor 1024 on the downstream side of the feeding direction than rollers 1028 and 1030 is kept OFF. Specifically, the state of FIG. 12B changes to that of FIG. 12C.

At this time, the two sheets of paper fed in overlapped manner are kept in waiting at the nip formed by rollers 1008 and 1010 with the tip end of upper sheet P3 protruding slightly to the downstream side in the feeding direction than the tip end of lower sheet P2. Therefore, it is likely that the normal feeding state is resumed by performing the re-feeding operation.

Figure 12D:
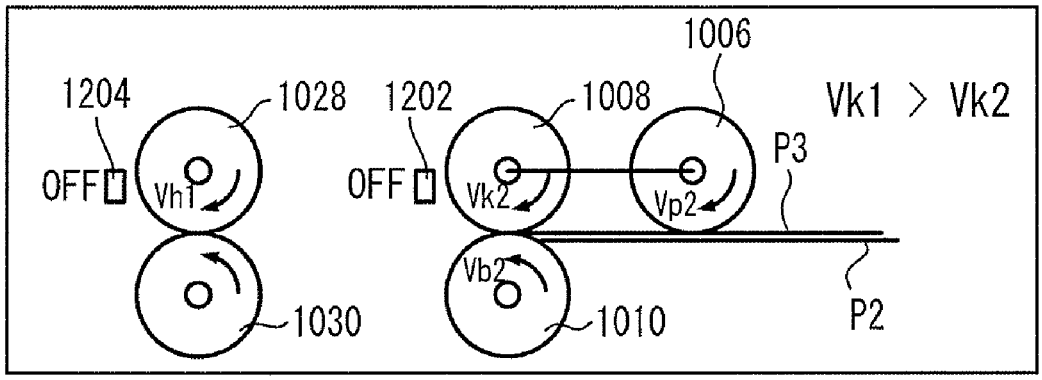

Therefore, the re-feeding operation is performed by rotating roller 1006 and rollers 1008 and 1010 forming the vertical pair in the feeding direction, with the speed of rotation of roller 1008 reduced from Vk1 to Vk2. This state is shown in FIG. 12D. At this time, the speed of rotation of roller 1006 that rotates in the feeding direction following roller 1008 is reduced from Vp1 to Vp2, and the speed of rotation of roller 1010 that also rotates in the feeding direction following roller 1008 is reduced from Vb1 to Vb2.

Figure 12E:
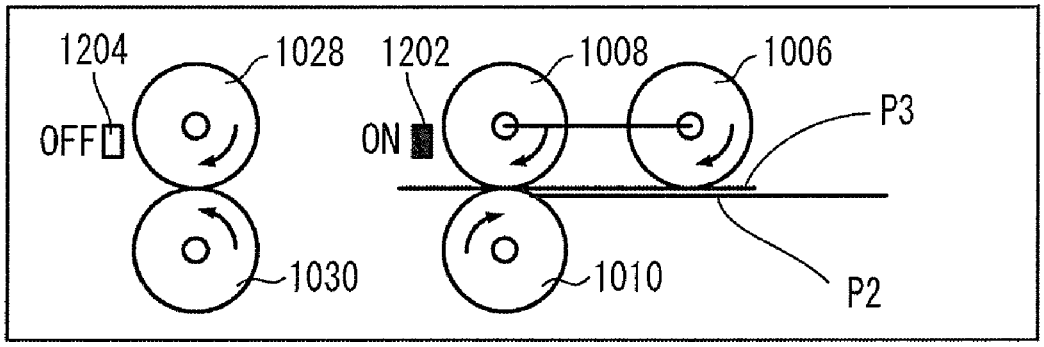

After the re-feeding operation, the separating operation is again performed by rotating roller 1010 in the reverse feeding direction. If the upper sheet P3 and the lower sheet P2 are separated by the returning force of roller 1010, upper sheet P3 is fed to the downstream side in the feeding direction by roller 1008, the tip end thereof protrudes from the nip formed by rollers 1008 and 1010 and whereby the sensor 1202 is turned ON as a result of the separating operation, it is determined that the normal feeding operation is resumed. This state is shown in FIG. 12E.

Figure 13A:
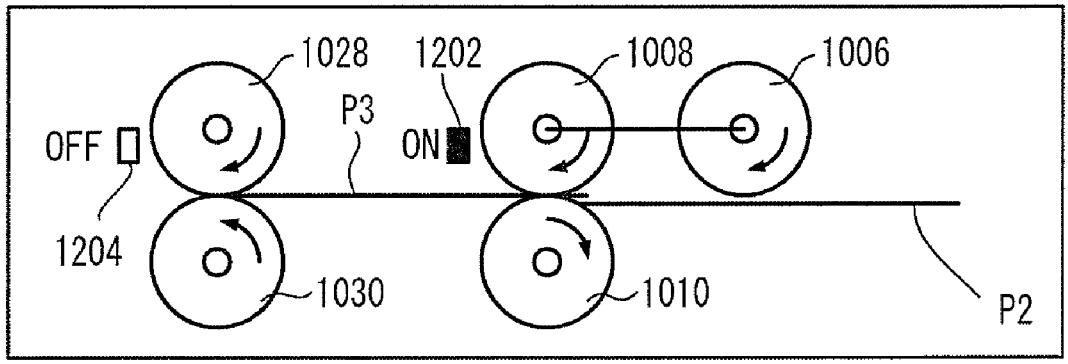

When the feeding state returns to the normal state as described above, the upper sheet of paper P3 that has turned ON the sensor 1202 is further fed to the downstream side in the feeding direction by roller 1008, and the tip end thereof enters the nip formed by rollers 1028 and 1030. This state is shown in FIG. 13A. At this time, the upper sheet P3 is not yet fully out of the space between rollers 1008 and 1010 and, therefore, the ON state of sensor 1202 is maintained.

Figure 13B:
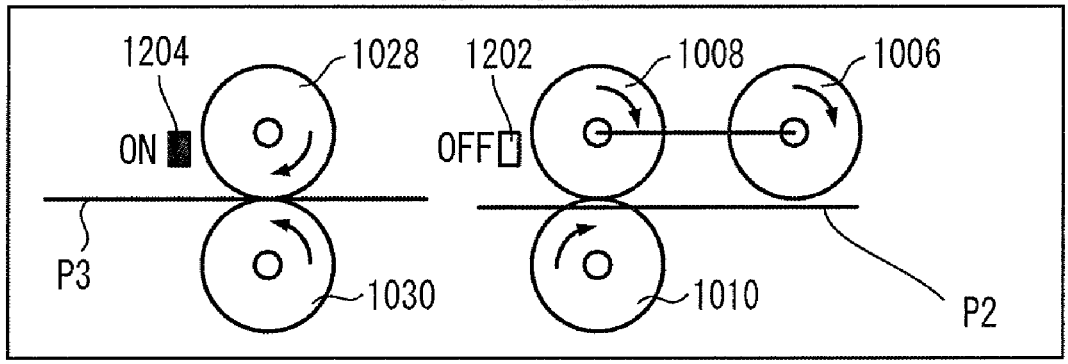

Thereafter, when the upper sheet P3 passes through rollers 1028 and 1030 and its tip end turns ON the sensor 1204, it is determined that one sheet of paper has been normally fed, and the printing process follows continuously. This state is shown in FIG. 13B.

Figure 12F:
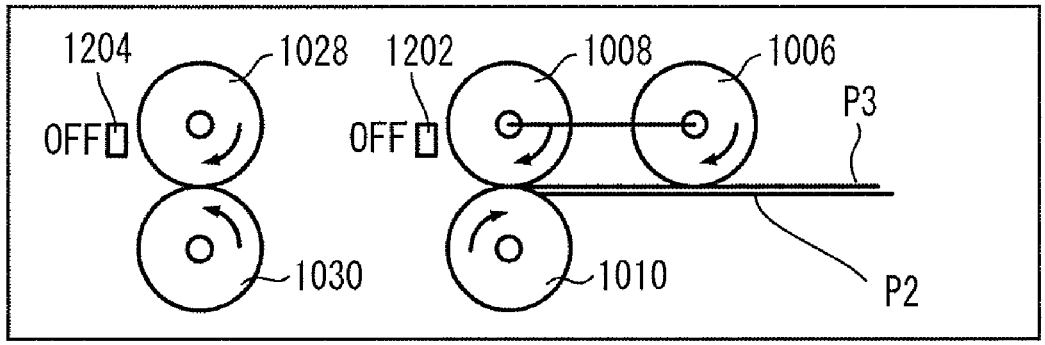

On the other hand, if the state of paper feed failure described above is not solved by the separating operation after the re-feeding operation, the re-feeding operation is executed repeatedly. Specifically, the state of FIG. 12F is returned to the state of FIG. 12D.

In the present embodiment, the re-feeding operation described above is repeated three times and if the paper feed failure state is still unsolved, it is determined that a paper jam occurred before reaching sensor 1024, and the operation is stopped.

<Function/Effect>

According to the present invention, when two or more sheets of paper P are fed in an overlapped manner to a nip where paper feed roller 1008 and separation roller 1010 are in pressure contact with each other, sub-CPU 1200 of sheet feeding unit 59 causes roller 1008 to rotate in a paper feeding direction, and causes roller 1010 to rotate in a direction opposite to the paper feeding direction, to solve the overlapped feeding and, thereafter, causes rollers 1008 and 1010 to rotate again in the direction of feeding the paper. Thus, possibility of resuming normal feeding condition can be improved.

Further, according to the present invention, if a sheet of paper P is not detected by paper feed sensor 1202, sub-CPU 1200 causes rollers 1008 and 1010 to rotate in the paper feeding direction. As a result, possibility of resuming normal feeding condition can further be improved.

Further, according to the present invention, sub-CPU 1200 repeats the operation of rotating rollers 1008 and 1010 in the paper feeding direction for a prescribed number of times. As a result, possibility of resuming normal feeding condition can further be improved. The prescribed number should preferably be set to three to five, in consideration of life of rollers 1008 and 1010.

Further, according to the present invention, sub-CPU 1200 repeats the operation of rotating rollers 1008 and 1010 in the paper feeding direction for a prescribed number of times and, thereafter, provides an indication of paper feed failure on display panel 1126 of operating unit 1124, and stops the operation of the apparatus. As a result, at the time of paper feed failure, unnecessary suspension of the operation of the apparatus can be prevented, and the user can easily recognize a paper feed failure. Thus, convenience for the user can be improved.

Further, according to the present invention, sub-CPU 1200 sets speed of rotation Vk2 of roller 1008 in the re-feeding operation slower than the speed of rotation Vk1 before detection of sheet P by sensor 1202, that is, the speed in the feeding operation.

As a result, in the re-feeding operation, frictional force between each of rollers 1008 and 1010 and the sheet of paper P can be increased than in the feeding operation, and hence, rollers 1008 and 1010 are less prone to slippage on the sheet P. Therefore, sheet of paper P can more reliably be fed to sensor 1202. This effect is particularly noticed when roller 1010 rotates driven by and following the rotation of roller 1008.

In the embodiment above, an example has been described in which the present invention is applied to the first paper feed system. The present invention is not limited to such a configuration. By way of example, the present invention may be applied to the second or third paper feed system. Further, in the embodiment above, a configuration has been described in which the paper feed program is transmitted from another device to the controller 1110 through LAN line 1118 and NIC 1112 and stored in ROM 1104 or HDD 1108. The present invention, however, is not limited to such a configuration. By way of example, in place of NIC 1112, various disk drives such as a DVD drive, CD-ROM drive or FD drive, a memory port and the like may be provided, and thereby the paper feed program recorded on an external recording medium may be loaded to the image forming apparatus 1A. In that case also, the object of the present invention can fully be attained. Other design changes and modifications within the scope of appended claims may be added.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

What is claimed is:

1. A paper feeder feeding sheets of paper contained stacked in a paper feed cassette one by one from an uppermost layer to a paper feed path, comprising:

a paper feed roller and a separation roller forming a pair in a vertical direction and by rotating in a paper feeding direction, passing said sheet of paper through a first nip where the rollers are in pressure contact with each other;

a first paper sensor arranged on a downstream side of said paper feed roller in the feeding direction;

a pair of conveyor rollers forming a pair in the vertical direction, arranged on the downstream side of said paper feed roller and said separation roller in the paper feeding direction, and by rotating in the feeding direction, passing said sheet of paper through a second nip where the pair of conveyor rollers are in pressure contact with each other;

a second paper sensor arranged on a downstream side of said pair of conveyor rollers in the feeding direction;

a first controller causing said paper feed roller to rotate in the feeding direction and causing said separation roller to rotate in a direction opposite to the feeding direction, when said first paper sensor detects said paper and a plurality of said sheets of paper exist at said first nip; and a second controller causing said paper feed roller and said separation roller to rotate in the feeding direction, when said paper is once detected but thereafter no longer detected by said first paper sensor, and said paper is not detected by said second paper sensor within a prescribed time period.

2. The paper feeder according to claim 1, further comprising a third controller causing said paper feed roller and said separation roller to rotate in the feeding direction, when said paper is not detected by said first paper sensor.

3. The paper feeder according to claim 2, further comprising a fourth controller causing said paper feed roller and said separation roller to repeat rotation in the feeding direction for a prescribed number of times, by controlling said second controller.

4. The paper feeder according to claim 3, further comprising a fifth controller stopping an operation of said paper feeder, after said second controller caused said paper feed roller and said separation roller to repeat rotation in the feeding direction for the prescribed number of times.

5. The paper feeder according to claim 4, further comprising:

a display unit for displaying information to be notified to a user; and a sixth controller causing said display unit to display an indication of paper failure, in response to said fifth controller stopping operation of the paper feeder.

6. The paper feeder according to claim 1, wherein said second controller sets rotation speed of said paper feed roller slower than rotation speed before detection of the paper by said first paper sensor.

7. An image forming apparatus, comprising:

a paper feeder feeding sheets of paper contained stacked in a paper feed cassette one by one from an uppermost layer to a paper feed path, including a paper feed roller and a separation roller forming a pair in a vertical direction and by rotating in a paper feeding direction, passing said sheet of paper through a first nip where the rollers are in pressure contact with each other, a first paper sensor arranged on a downstream side of said paper feed roller in the feeding direction, a pair of conveyor rollers forming a pair in the vertical direction, arranged on the downstream side of said paper feed roller and said separation roller in the paper feeding direction, and by rotating in the feeding direction, passing said sheet of paper through a second nip where the pair of conveyor rollers are in pressure contact with each other, a second paper sensor arranged on a downstream side of said pair of conveyor rollers in the feeding direction, a first controller causing said paper feed roller to rotate in the feeding direction and causing said separation roller to rotate in a direction opposite to the feeding direction, when said first paper sensor detects said paper and a plurality of said sheets of paper exist at said first nip, and a second controller causing said paper feed roller and said separation roller to rotate in the feeding direction, when said paper is once detected but thereafter no longer detected by said first paper sensor, and said paper is not detected by said second paper sensor within a prescribed time period; and an image forming unit forming a desired image on a sheet of paper fed to said paper feed path.

8. A paper feeding method of feeding sheets of paper contained stacked in a paper feed cassette one by one from an uppermost layer to a paper feed path, comprising the steps of:

rotating, in a paper feeding direction, a paper feed roller and a separation roller forming a pair in a vertical direction to form a first nip, and thereby passing said sheet of paper through said first nip;

rotating, in the paper feeding direction, a pair of conveyor rollers arranged on a downstream side of said paper feed roller and said separation roller in the feeding direction and forming a pair in the vertical direction to form a second nip, and thereby passing said sheet of paper through said second nip;

rotating said paper feed roller in the feeding direction and rotating said separation roller in a direction opposite to the feeding direction, when a first paper sensor, provided on the downstream side of said paper feed roller in the feeding direction, detects said paper and a plurality of said sheets of paper exist at said first nip; and rotating said paper feed roller and said separation roller in the feeding direction, when said paper is once detected but thereafter no longer detected by said first paper sensor, and said paper is not detected by a second paper sensor, arranged on the downstream side of said conveyor roller pair in the feeding direction, within a prescribed time period.

9. A paper feed program, causing, when executed by a computer, said computer to execute a paper feeding method of feeding sheets of paper contained stacked in a paper feed cassette one by one from an upper most layer to a paper feed path, said paper feeding method including the steps of:

rotating, in a paper feeding direction, a paper feed roller and a separation roller forming a pair in a vertical direction to form a first nip, and thereby passing said sheet of paper through said first nip;

rotating, in the paper feeding direction, a pair of conveyor rollers arranged downstream of said paper feed roller and said separation roller in the feeding direction and forming a pair in the vertical direction to form a second nip, and thereby passing said sheet of paper through said second nip;

rotating said paper feed roller in the feeding direction and rotating said separation roller in a direction opposite to the feeding direction, when a first paper sensor, provided on the downstream side of said paper feed roller in the feeding direction, detects said paper and a plurality of said sheets of paper exist at said first nip; and rotating said paper feed roller and said separation roller in the feeding direction, when said paper is once detected but thereafter no longer detected by said first paper sensor, and said paper is not detected by a second paper sensor, arranged on the downstream side of said pair of conveyor rollers in the feeding direction, within a prescribed time period.

10. A computer-readable recording medium recording a paper feed program, causing, when executed by a computer, said computer to execute a paper feeding method of feeding sheets of paper contained stacked in a paper feed cassette one by one from an uppermost layer to a paper feed path, said paper feeding method including the steps of:

rotating, in a paper feeding direction, a paper feed roller and a separation roller forming a pair in a vertical direction to form a first nip, and thereby passing said sheet of paper through said first nip;

rotating, in the paper feeding direction, a pair of conveyor rollers arranged downstream of said paper feed roller and said separation roller in the feeding direction and forming a pair in the vertical direction to form a second nip, and thereby passing said sheet of paper through said second nip;

rotating said paper feed roller in the feeding direction and rotating said separation roller in a direction opposite to the feeding direction, when a first paper sensor, provided on the downstream side of said paper feed roller in the feeding direction, detects said paper and a plurality of said sheets of paper exist at said first nip; and rotating said paper feed roller and said separation roller in the feeding direction, when said paper is once detected but thereafter no longer detected by said first paper sensor, and said paper is not detected by a second paper sensor, arranged on the downstream side of said pair of conveyor rollers in the feeding direction, within a prescribed time period.

* * * * *